US008581807B2

(12) United States Patent
Yamamoto et al.

(10) Patent No.: US 8,581,807 B2
(45) Date of Patent: Nov. 12, 2013

(54) DISPLAY DEVICE AND PIXEL CIRCUIT DRIVING METHOD ACHIEVING DRIVING TRANSISTOR THRESHOLD VOLTAGE CORRECTION

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 808 days.

(21) Appl. No.: 12/457,316

(22) Filed: Jun. 8, 2009

(65) Prior Publication Data

US 2009/0322734 A1 Dec. 31, 2009

(30) Foreign Application Priority Data

Jun. 25, 2008 (JP) ..... 2008-165201

(51) Int. Cl.
*G09G 3/30* (2006.01)

(52) U.S. Cl.
USPC ..... 345/77

(58) Field of Classification Search
USPC ..... 345/78, 77, 82, 211, 214
See application file for complete search history.

(56) References Cited

U.S. PATENT DOCUMENTS

| | | | | |
|---|---|---|---|---|
| 2007/0152920 | A1* | 7/2007 | Yamashita et al. | 345/76 |
| 2008/0030436 | A1* | 2/2008 | Iida et al. | 345/77 |
| 2009/0243978 | A1* | 10/2009 | Yamamoto et al. | 345/76 |

FOREIGN PATENT DOCUMENTS

| | | |
|---|---|---|
| JP | 2005-258326 | 9/2005 |
| JP | 2006-215213 | 8/2006 |
| JP | 2007-133282 A | 5/2007 |
| JP | 2008-033193 A | 2/2008 |

OTHER PUBLICATIONS

Japanese Office Action issued Jun. 2, 2010 for corresponding Japanese Application No. 2008-165201.

* cited by examiner

*Primary Examiner* — Chanh Nguyen
*Assistant Examiner* — John Kirkpatrick
(74) *Attorney, Agent, or Firm* — Rader, Fishman & Grauer PLLC

(57) ABSTRACT

Disclosed herein is a display device including a pixel array section having pixel circuits arranged in a form of a matrix, the pixel circuits each including a driving transistor for generating a driving current, an electrooptic element connected to an output terminal of the driving transistor, a storage capacitor for retaining information corresponding to signal amplitude of a video signal, and a sampling transistor for writing the information corresponding to the signal amplitude to the storage capacitor; a vertical scanning section configured to generate a vertical scanning pulse for vertical scanning of the pixel circuits; a horizontal scanning section configured to supply the video signal to the pixel circuits so as to coincide with the vertical scanning in the vertical scanning section; and a driving signal constancy achieving circuit for holding the driving current constant.

20 Claims, 10 Drawing Sheets

DISPLAY DEVICE AND PIXEL CIRCUIT DRIVING METHOD ACHIEVING DRIVING TRANSISTOR THRESHOLD VOLTAGE CORRECTION

BACKGROUND OF THE INVENTION

1. Field of the Invention

The present invention relates to a display device having a pixel circuit (referred to also as a pixel) provided with an electrooptic element (referred to also as a display element or a light emitting element), and particularly to a display device having a current-driven type electrooptic element changing in luminance according to the magnitude of a driving signal as a display element, and having an active element in each pixel circuit, display driving being performed in a pixel unit by the active element.

2. Description of the Related Art

There are display devices that use an electrooptic element changing in luminance according to a voltage applied to the electrooptic element or a current flowing through the electrooptic element as a display element of a pixel. For example, a liquid crystal display element is a typical example of an electrooptic element that changes in luminance according to a voltage applied to the electrooptic element, and an organic electroluminescence (hereinafter described as organic EL) element (organic light emitting diode (OLED)) is a typical example of an electrooptic element that changes in luminance according to a current flowing through the electrooptic element. An organic EL display device using the latter organic EL element is a so-called emissive display device using a self-luminous electrooptic element as a display element of a pixel.

The organic EL element includes an organic thin film (organic layer) formed by laminating an organic hole transporting layer and an organic light emitting layer between a lower electrode and an upper electrode. The organic EL element is an electrooptic element using a phenomenon of light emission occurring on application of an electric field to the organic thin film. A color gradation is obtained by controlling the value of current flowing through the organic EL element.

The organic EL element can be driven by a relatively low application voltage (for example 10 V or lower), and thus consumes low power. In addition, the organic EL element is a self-luminous element that emits light by itself, and therefore obviates a need for an auxiliary illuminating member such as a backlight desired in a liquid crystal display device. Thus the organic EL element facilitates reduction in weight and thickness. Further, the organic EL element has a very high response speed (for example a few μs or so), so that no afterimage occurs at a time of displaying a moving image. Because the organic EL element has these advantages, flat-panel emissive display devices using the organic EL element as an electrooptic element have recently been actively developed.

Display devices using an electrooptic element including liquid crystal display devices using a liquid crystal display element and organic EL display devices using an organic EL element can adopt a simple (passive) matrix system and an active matrix system as a driving system of the display devices. However, while having a simple structure, a simple matrix type display device presents for example a problem of difficulty in realizing a large and high-definition display device.

Thus an active matrix system that controls a pixel signal supplied to a light emitting element within a pixel by using an active element similarly provided within the pixel, for example an insulated gate field effect transistor (typically a thin film transistor (TFT)) as a switching transistor has recently been actively developed.

When an electrooptic element within a pixel circuit is made to emit light, an input image signal supplied via a video signal line is captured into a storage capacitor (referred to also as a pixel capacitance) provided to the gate terminal (control input terminal) of a driving transistor by a switching transistor (referred to as a sampling transistor), and a driving signal corresponding to the captured input image signal is supplied to the electrooptic element.

In a liquid crystal display device using a liquid crystal display element as an electrooptic element, because the liquid crystal display element is a voltage-driven type element, the liquid crystal display element is driven by a voltage signal itself corresponding to an input image signal captured into a storage capacitor. On the other hand, in an organic EL display device using a current-driven type element such as an organic EL element or the like as an electrooptic element, a driving transistor converts a driving signal (voltage signal) corresponding to an input image signal captured into a storage capacitor into a current signal, and the driving current is supplied to the organic EL element or the like.

The current-driven type electrooptic element typified by the organic EL element varies in light emission luminance when the value of the driving current varies. Hence, in order to make the electrooptic element emit light at stable luminance, it is important to supply stable driving current to the electrooptic element. For example, a driving system for supplying the driving current to the organic EL element can be roughly classified into a constant-current driving system and a constant-voltage driving system (which are well known techniques, so that publicly known documents will not be presented here).

Because the voltage-current characteristic of the organic EL element has a steep slope, when constant-voltage driving is performed, slight variations in voltage or variations in element characteristic cause great variations in current and thus bring about great variations in luminance. Hence, constant-current driving in which the driving transistor is used in a saturation region is generally used. Of course, even with constant-current driving, changes in current invite variations in luminance. However, small variations in current cause only small variations in luminance.

Conversely, even with the constant-current driving system, in order for the light emission luminance of the electrooptic element to be unchanged, it is important for the driving signal written to the storage capacitor according to the input image signal and retained by the storage capacitor to be constant. For example, in order for the light emission luminance of the organic EL element to be unchanged, it is important for the driving current corresponding to the input image signal to be constant.

However, the threshold voltage and mobility of the active element (driving transistor) driving the electrooptic element vary due to process variations. In addition, characteristics of the electrooptic element such as the organic EL element or the like vary with time. Such variations in the characteristics of the active element for driving and such variations in the characteristics of the electrooptic element affect light emission luminance even in the case of the constant-current driving system.

Thus, various mechanisms for correcting luminance variations caused by the above-described variations in the characteristics of the active element for driving and the electrooptic element within each pixel circuit are being studied to uniformly control the light emission luminance over the entire screen of a display device.

For example, a mechanism described in Japanese Patent Laid-Open No. 2006-215213 (hereinafter referred to as Patent Document 1) as a pixel circuit for an organic EL element has a threshold value correcting function for holding driving current constant even when there is a variation or a secular change in threshold voltage of a driving transistor, a mobility correcting function for holding the driving current constant even when there is a variation or a secular change in mobility of the driving transistor, and a bootstrap function for holding the driving current constant even when there is a secular change in current-voltage characteristic of the organic EL element.

During threshold value correcting operation, a power supply voltage of a predetermined magnitude is supplied to the power supply terminal of the driving transistor to create a state of a current flowing between the drain and the source of the driving transistor, and the sampling transistor is made to conduct with a reference potential of a predetermined magnitude for threshold value correction supplied to the input terminal of the sampling transistor.

In this case, depending on driving timing, the period of threshold value correcting operation may be insufficient, and thus a voltage corresponding to the threshold voltage of the driving transistor may not be completely retained in the storage capacitor. For a measure against such a phenomenon, adopting a mechanism of making the storage capacitor surely retain the voltage corresponding to the threshold voltage of the driving transistor by repeatedly performing threshold value correcting operation a plurality of times is considered (see Japanese Patent Laid-Open No. 2005-258326).

SUMMARY OF THE INVENTION

However, in the case of performing threshold value correcting operation a plurality of times while the current remains flowing through the driving transistor, when the sampling transistor is set in a non-conducting state in an interval period between threshold value correcting operations, the threshold voltage of the driving transistor is not completely corrected at this time, and therefore a voltage across the storage capacitor, that is, a voltage between the control input terminal (gate) and the terminal on the electrooptic element side of the driving transistor is larger than the threshold voltage.

When the threshold value correcting time is short or the time of the interval period is long, the potential of the terminal on the electrooptic element side of the driving transistor rises greatly in the interval period. As a result, the voltage across the storage capacitor becomes less than the threshold voltage during the next threshold value correcting operation, and thereafter threshold value correcting operation is not performed normally, which results in nonuniformity or stripes appearing in a display image.

The mechanism described in Patent Document 1 desires wiring for supplying potential for correction, a switching transistor for correction, and a pulse for switching which pulse drives the switching transistor. The mechanism described in Patent Document 1 employs a 5TR driving configuration when a driving transistor and a sampling transistor are included, so that the configuration of a pixel circuit is complex with a large number of vertical scanning lines and the like. Many constituent elements of the pixel circuit hinder achievement of higher definition of the display device. As a result, it is difficult to apply the 5TR driving configuration to a display device used in a small electronic device such as a portable device (mobile device) or the like.

There is thus a desire to develop a mechanism for easing the problem of threshold value correcting operation not being performed normally while simplifying the pixel circuit. At this time, consideration should also be given to preventing a new problem that does not occur with the 5TR driving configuration from occurring with the reduction of the number of scanning lines and the simplification of the pixel circuit.

The present invention has been made in view of the above situation. It is desirable to provide a mechanism that can ease the problem of threshold value correcting operation not being performed normally even when a mechanism of performing the threshold value correcting operation is adopted as a mechanism for suppressing changes in luminance due to variations in characteristics of the driving transistor. It is also desirable to provide a mechanism that enables higher definition of the display device by simplifying the pixel circuit.

One form of a display device according to the present invention includes: a pixel array section having pixel circuits arranged in a form of a matrix, the pixel circuits each including a driving transistor for generating a driving current, an electrooptic element connected to an output terminal of the driving transistor, a storage capacitor for retaining information corresponding to signal amplitude of a video signal, and a sampling transistor for writing the information corresponding to the signal amplitude to the storage capacitor; a vertical scanning section for generating a vertical scanning pulse for vertical scanning of the pixel circuits; a horizontal scanning section for supplying the video signal to the pixel circuits so as to coincide with the vertical scanning in the vertical scanning section; and a driving signal constancy achieving circuit for holding the driving current constant.

The driving signal constancy achieving circuit realizes a threshold value correcting function that makes the storage capacitor retain a voltage corresponding to a threshold voltage of the driving transistor by making the sampling transistor conduct in a time period in which a power supply voltage of a predetermined magnitude is supplied to a power supply terminal of the driving transistor and a reference potential of a predetermined magnitude is supplied to an input terminal of the sampling transistor under control of the vertical scanning section and the horizontal scanning section.

Further, as a first mechanism, the driving signal constancy achieving circuit performs threshold value correcting operation a plurality of times while a state of a current flowing through the driving transistor is maintained with one horizontal scanning period as one process cycle, and performs a threshold value correcting divided process within one horizontal period in which process a threshold value correcting process is performed while conduction and non-conduction of the sampling transistor are repeated a plurality of times with the reference potential for threshold value correction supplied to the input terminal of the sampling transistor in at least one of threshold value correcting process periods.

In addition, as a second mechanism, the driving signal constancy achieving circuit performs a preparatory process that sets a voltage across the storage capacitor so as to exceed the threshold voltage of the driving transistor prior to a first threshold value correcting process, sets the sampling transistor in a non-conducting state and passes a current through the driving transistor after the preparatory process and before a start of the first threshold value correcting process, and turns on the sampling transistor and starts threshold value correcting operation after passage of a certain period. That is, the voltage on the electrooptic element side of the driving transistor at the time of the start of the first threshold value correcting process is made close to the potential of the control input terminal of the driving transistor, and then the threshold value correcting operation is started.

Either of the mechanisms turns off the sampling transistor in a short period in which a phenomenon of failure of threshold value correction does not occur, thereby raising the potential on the electrooptic element side of the driving transistor while maintaining the voltage across the storage capacitor at that point in time, and thereafter turns on the sampling transistor to set the control input terminal of the driving transistor to the reference potential for threshold value correction and start threshold value correcting operation. This provides an effect of increasing the speed of threshold value correcting operation due to the rising of the voltage on the electrooptic element side of the driving transistor in a range in which the phenomenon of failure of threshold value correction does not occur.

According to one form of the present invention, the sampling transistor is turned off for a very short period in a state of a current flowing through the driving transistor, whereby the potential on the electrooptic element side of the driving transistor can be raised while the voltage across the storage capacitor immediately before the very short period is maintained. Thus, when threshold value correcting operation is thereafter started, as compared with a case of not adopting the present mechanism, the voltage across the storage capacitor is closer to the threshold voltage, so that the speed of the threshold value correcting operation can be increased and the threshold value correcting operation can be performed normally. Because the threshold value correcting operation can be performed normally, problems such as nonuniformity, stripes and the like appearing in a display image which problems result from the threshold value correcting operation not being performed normally can be eased.

In addition, when the mechanism of performing threshold value correcting operation a plurality of times and passing a current through the driving transistor in an interval period between threshold value correcting operations is adopted, a problem of the next threshold value correcting operation not being performed normally due to the current flowing from a power supply through the driving transistor in the interval period can be eased.

Further, as an additional effect, because the speed of threshold value correcting operation can be increased, the speed of a threshold value correcting operation process as a whole can be increased.

DETAILED DESCRIPTION OF THE PREFERRED EMBODIMENTS

Preferred embodiments of the present invention will hereinafter be described in detail with reference to the drawings.

<General Outline of Display Device>

Figure 1:
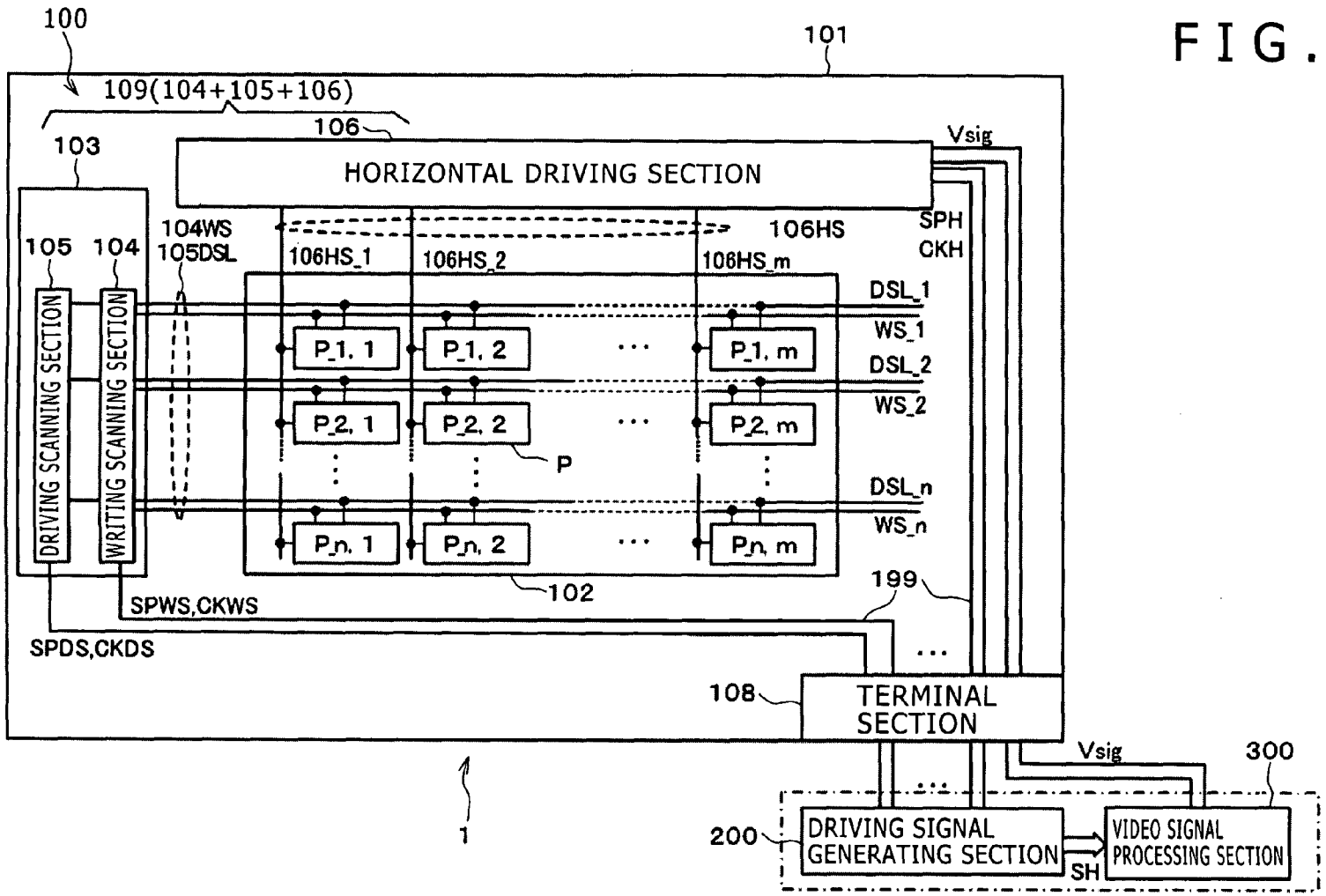
FIG. 1 is a block diagram showing an outline of a configuration of an active matrix type display device as an embodiment of a display device according to the present invention.

FIG. 1 is a block diagram showing an outline of a configuration of an active matrix type display device as an embodiment of a display device according to the present invention. The present embodiment will be described by taking as an example a case where the present invention is applied to an active matrix type organic EL display (hereinafter referred to as an "organic EL display device") using for example an organic EL element as a display element (an electrooptic element or a light emitting element) of a pixel and a polysilicon thin film transistor (TFT) as an active element, the organic EL element being formed on a semiconductor substrate where the thin film transistor is formed. Such an organic EL display device is used as a display section of a portable type music player using a recording medium such as a semiconductor memory, a minidisc (MD), a cassette tape or the like and other electronic devices.

Incidentally, while concrete description will be made in the following by taking the organic EL element as an example of the display element of the pixel, the organic EL element is an example, and the display element of interest is not limited to the organic EL element. All embodiments to be described later are similarly applicable to all display elements that generally emit light by being driven by current.

As shown in FIG. 1, the organic EL display device 1 includes: a display panel section 100 in which pixel circuits (referred to also as pixels) P having organic EL elements (not shown) as a plurality of display elements are arranged so as to form an effective video area having a mode ratio of X:Y (for example 9:16) as a display aspect ratio; a driving signal generating section 200 as an example of a panel controlling section that issues various pulse signals for driving and controlling the display panel section 100; and a video signal processing section 300. The driving signal generating section 200 and the video signal processing section 300 are included in an IC (integrated circuit) on a single chip.

For example, the whole of the panel type display device is generally formed with a pixel array section 102 in which elements forming the pixel circuits such as TFTs and electrooptic elements are arranged in the form of a matrix, a controlling section 109 having as a main part thereof a scanning section (a horizontal driving section and a vertical driving section) disposed on the periphery of the pixel array section 102 and connected to scanning lines for driving each pixel circuit P, and the driving signal generating section 200 and the video signal processing section 300 that generate various signals for operating the controlling section 109.

On the other hand, a product form is not limited to the provision of the organic EL display device 1 in the form of a module (composite part) having all of the display panel section 100, the driving signal generating section 200, and the video signal processing section 300 though the display panel section 100 having the pixel array section 102 and the controlling section 109 on a same substrate 101 (glass substrate) is separate from the driving signal generating section 200 and the video signal processing section 300, as shown in FIG. 1. It is possible to include the pixel array section 102 in the display panel section 100 and provide merely the display panel section 100 as the organic EL display device 1. In this case, peripheral circuits such as the controlling section 109, the driving signal generating section 200, and the video signal processing section 300 are mounted on a substrate (for example flexible substrate) separate from the organic EL display device 1 formed by the display panel section 100 alone (which form will be referred to as a peripheral circuit extra-panel arrangement configuration).

In the case of an on-panel arrangement configuration where the display panel section 100 is formed by mounting the pixel array section 102 and the controlling section 109 on the same substrate 101, a mechanism (referred to as a TFT integrated configuration) in which each TFT for the controlling section 109 (and the driving signal generating section 200 and the video signal processing section 300 as desired) is formed simultaneously in a process of forming TFTs of the pixel array section 102 may be adopted, or a mechanism (referred to as a COG mounting configuration) in which a semiconductor chip for the controlling section 109 (and the driving signal generating section 200 and the video signal processing section 300 as desired) is directly mounted on the substrate 101 having the pixel array section 102 mounted thereon by COG (Chip On Glass) mounting technology may be adopted.

The display panel section 100 includes for example the pixel array section 102 in which the pixel circuits P are arranged in the form of a matrix of n rows×m columns, a vertical driving unit 103 as an example of a vertical scanning section configured to scan the pixel circuits P in a vertical direction, a horizontal driving section (referred to also as a horizontal selector or a data line driving section) 106 as an example of a horizontal scanning section configured to scan the pixel circuits P in a horizontal direction, and a terminal section (pad section) 108 for external connection, the pixel array section 102, the vertical driving unit 103, the horizontal driving section 106, and the terminal section 108 being formed in an integrated manner on the substrate 101. That is, peripheral driving circuits such as the vertical driving unit 103 and the horizontal driving section 106 are formed on the same substrate 101 as the pixel array section 102.

The vertical driving unit 103 includes for example a writing scanning section (write scanner WS; Write Scan) 104 and a driving scanning section (drive scanner DS; Drive Scan) 105 functioning as a power scanner having a power supplying capability. The vertical driving unit 103 and the horizontal driving section 106 form the controlling section 109 configured to control the writing of a signal potential to a storage capacitor, threshold value correcting operation, mobility correcting operation, and bootstrap operation.

While the configuration of the vertical driving unit 103 and corresponding scanning lines is shown so as to be adapted to a case where the pixel circuits P are of a 2TR configuration according to the present embodiment to be described later, another scanning section may be provided depending on the configuration of the pixel circuits P.

As an example, the pixel array section 102 is driven by the writing scanning section 104 and the driving scanning section 105 from one side or both sides in the horizontal direction shown in FIG. 1, and is driven by the horizontal driving section 106 from one side or both sides in the vertical direction shown in FIG. 1.

The terminal section 108 is supplied with various pulse signals from the driving signal generating section 200 disposed outside the organic EL display device 1. In addition, the terminal section 108 is similarly supplied with a video signal Vsig from the video signal processing section 300. When color display is supported, video signals Vsig_R, Vsig_G, and Vsig_B for respective colors (three primary colors of R (red), G (green), and B (blue) in the present example) are supplied.

For example, necessary pulse signals such as shift start pulses SPDS and SPWS as an example of writing start pulses in the vertical direction and vertical scanning clocks CKDS and CKWS are supplied as pulse signals for vertical driving. In addition, necessary pulse signals such as a horizontal start pulse SPH as an example of a writing start pulse in the horizontal direction and a horizontal scanning clock CKH are supplied as pulse signals for horizontal driving.

Each terminal of the terminal section 108 is connected to the vertical driving unit 103 and the horizontal driving section 106 via wiring 199. For example, each pulse supplied to the terminal section 108 is internally adjusted in voltage level by a level shifter section not shown in the figure as desired, and thereafter supplied to each section of the vertical driving unit 103 and the horizontal driving section 106 via a buffer.

Though not shown in the figure (details will be described later), the pixel array section 102 has a constitution in which the pixel circuits P having a pixel transistor provided for the organic EL element as a display element are two-dimensionally arranged in the form of a matrix, a vertical scanning line is arranged for each row of the pixel arrangement, and a signal line (an example of a horizontal scanning line) is arranged for each column of the pixel arrangement.

For example, each scanning line on a vertical scanning side (vertical scanning line: a writing scanning line 104WS and a power supply line 105DSL) and a video signal line (data line) 106HS as a scanning line on a horizontal scanning side (horizontal scanning line) are formed in the pixel array section 102. The organic EL element not shown in the figure and a thin film transistor (TFT) for driving the organic EL element are formed at intersections of the respective scanning lines of the vertical scanning and the horizontal scanning. The pixel circuits P are formed with a combination of the organic EL element and the thin film transistor.

Specifically, writing scanning lines 104WS_1 to 104WS_*n* for n rows which scanning lines are driven by a writing driving pulse WS by the writing scanning section 104 and power supply lines 105DSL_1 to 105DSL_*n* for the n rows which power supply lines are driven by a power driving pulse DSL by the driving scanning section 105 are arranged in each pixel row of the pixel circuits P arranged in the form of a matrix.

The writing scanning section 104 and the driving scanning section 105 sequentially select each pixel circuit P via the writing scanning line 104WS and the power supply line 105DSL on the basis of the pulse signals for the vertical driving system which signals are supplied from the driving signal generating section 200. The horizontal driving section 106 samples a predetermined potential of the video signal Vsig and writes the predetermined potential to the storage capacitor of a selected pixel circuit P via the video signal line 106HS on the basis of the pulse signals for the horizontal driving system which signals are supplied from the driving signal generating section 200.

The organic EL display device 1 according to the present embodiment is capable of line-sequential driving, frame-sequential driving, or driving of another system. For example, the writing scanning section 104 and the driving scanning section 105 of the vertical driving unit 103 scan the pixel array section 102 in row units, and in synchronism with this, the horizontal driving section 106 simultaneously writes image signals for one horizontal line to the pixel array section 102.

The horizontal driving section 106 includes for example a driver circuit for simultaneously turning on switches not shown in the figure which switches are provided on the video signal lines 106HS of all the columns. The horizontal driving section 106 simultaneously turns on the switches not shown in the figure which switches are provided on the video signal lines 106HS of all the columns to simultaneously write an image signal input from the video signal processing section 300 to all pixel circuits P of one line of a row selected by the vertical driving unit 103. Thus the video signal Vsig (an example of a horizontal scanning signal) is supplied to the horizontal scanning line (video signal line 106HS) via the driver circuit.

Each section of the vertical driving unit 103 is formed by a combination of logic gates (including a latch) and a driver circuit. The pixel circuits P of the pixel array section 102 are selected in row units by the logic gates, and a vertical scanning signal is supplied to the vertical scanning line via the driver circuit. Incidentally, while FIG. 1 shows a configuration in which the vertical driving unit 103 is disposed on only one side of the pixel array section 102, a configuration in which the vertical driving unit 103 is disposed on both a left side and a right side with the pixel array section 102 interposed between the left side and the right side may be adopted. Similarly, while FIG. 1 shows a configuration in which the horizontal driving section 106 is disposed on only one side of the pixel array section 102, a configuration in which the horizontal driving section 106 is disposed on both an upper side and a lower side with the pixel array section 102 interposed between the upper side and the lower side may be adopted.

As is understood from the connection mode of the vertical driving unit 103 (the writing scanning section 104 and the driving scanning section 105), the horizontal driving section 106, the vertical scanning line (the writing scanning line 104WS and the power supply line 105DSL), and the horizontal scanning line (the video signal line 106HS), scanning lines are necessary to supply a scanning signal to each pixel circuit P of the pixel array section 102. In a simple mechanism, when the number of pixel circuits P is increased, the number of scanning lines is correspondingly increased, and the driver circuits for driving the scanning lines are also increased. While FIG. 1 shows a form in which scanning lines are arranged for each row and each column for convenience, a mechanism according to the present embodiment to be described later reduces the number of scanning lines (writing scanning lines 104WS in particular) while maintaining the number of pixels.

<Pixel Circuit>

Figure 2:
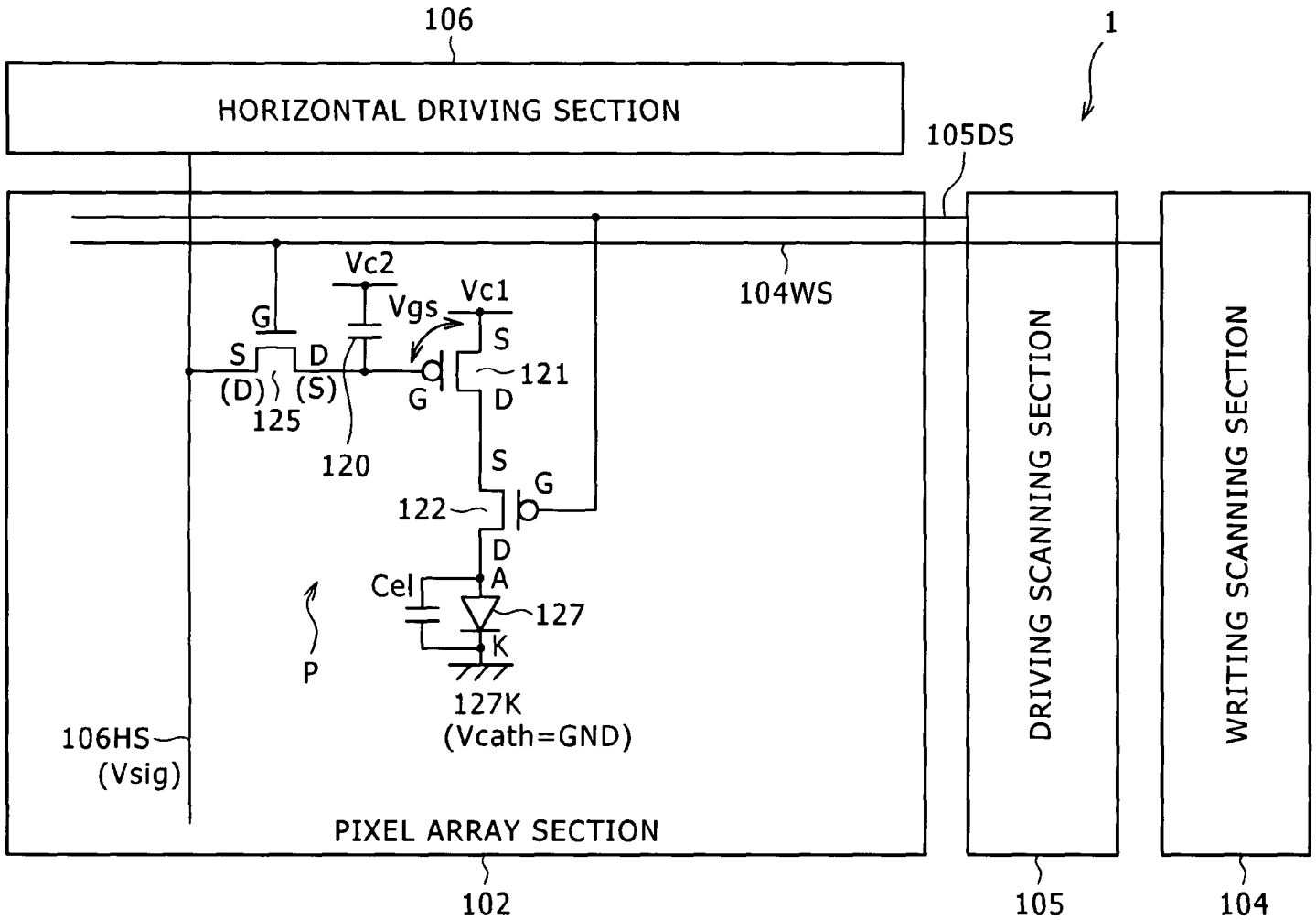
FIG. 2 is a diagram showing a first comparative example for pixel circuits according to the present embodiment.
Figure 3:
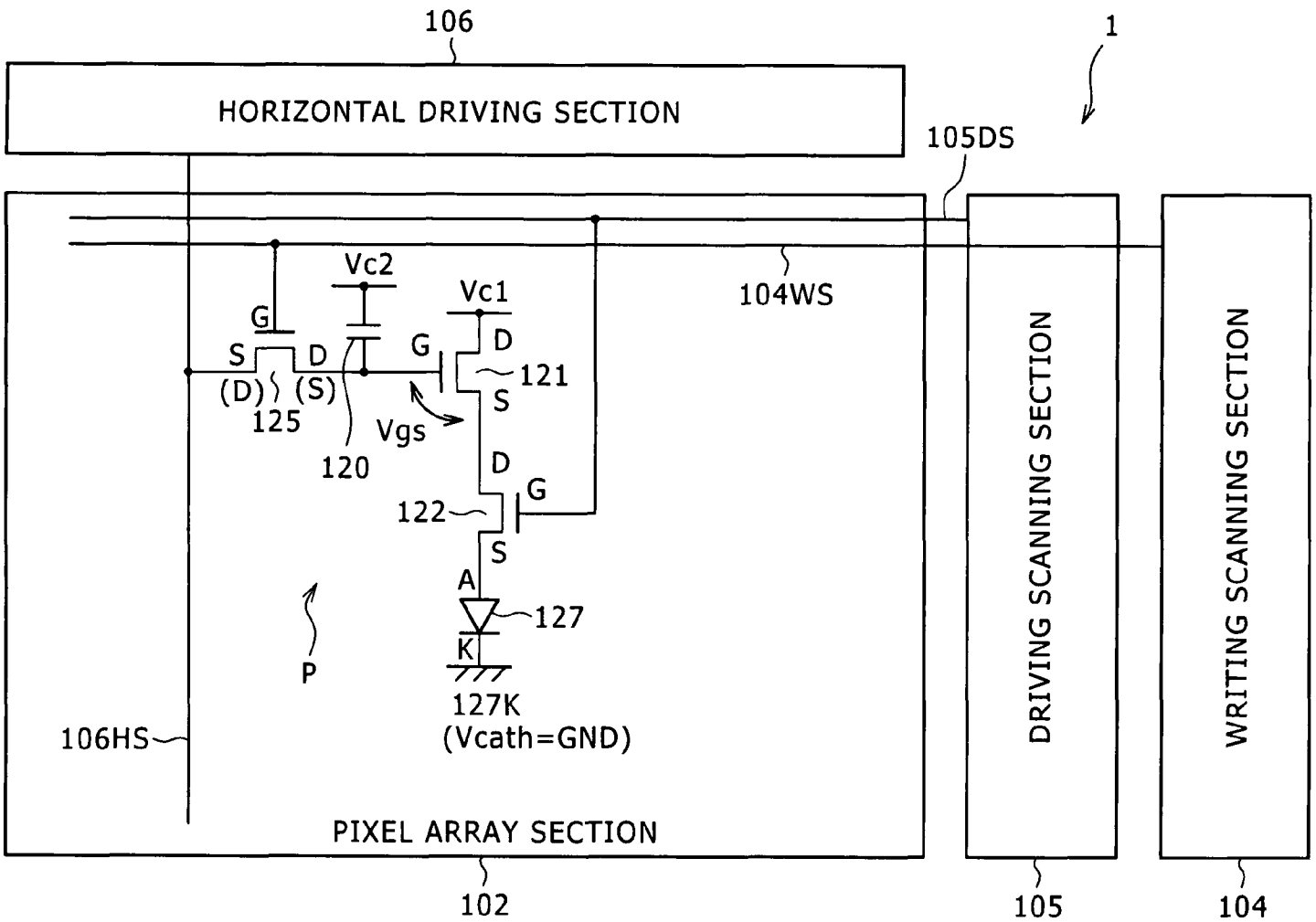
FIG. 3 is a diagram showing a second comparative example for the pixel circuits according to the present embodiment.
Figure 4:
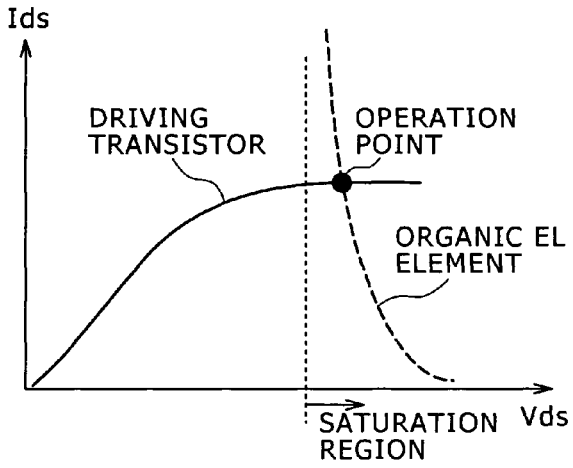
FIG. 4 is a diagram of assistance in explaining an operating point of an organic EL element and a driving transistor.
Figure 5A:
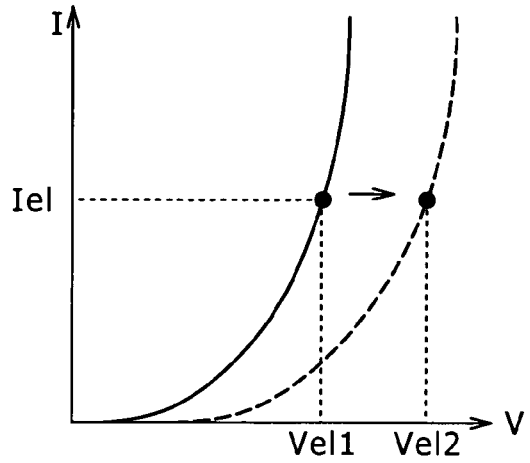
FIGS. 5A to 5C are diagrams of assistance in explaining effects of variations in characteristics of the organic EL element and the driving transistor on a driving current.
Figure 5B:
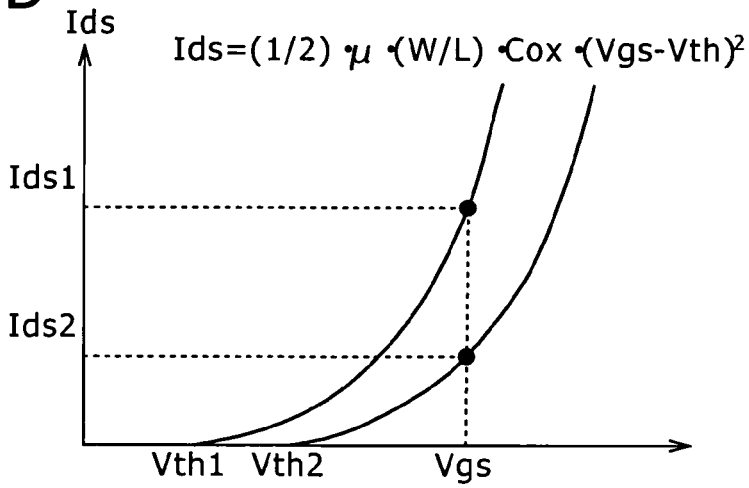
Figure 5C:
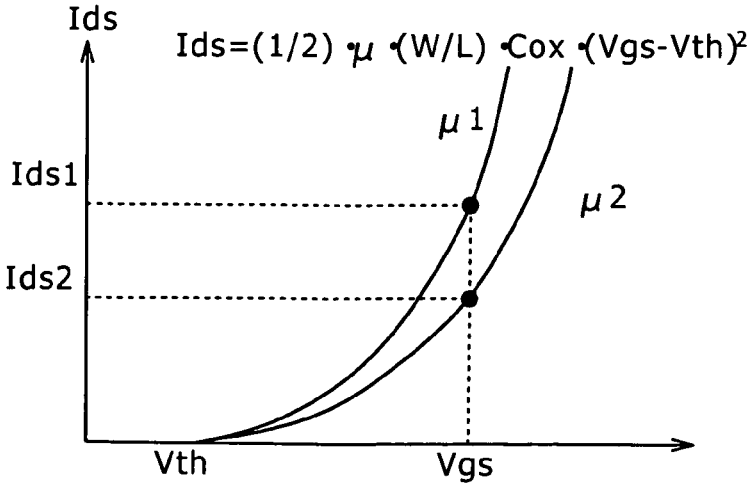

FIG. 2 is a diagram showing a first comparative example for the pixel circuits P according to the present embodiment forming the organic EL display device 1 shown in FIG. 1. Incidentally, FIG. 2 also shows the vertical driving unit 103 and the horizontal driving section 106 disposed in the peripheral part of the pixel circuits P on the substrate 101 of the display panel section 100. FIG. 3 is a diagram showing a second comparative example for the pixel circuits P according to the present embodiment. Incidentally, FIG. 3 also shows the vertical driving unit 103 and the horizontal driving section 106 disposed in the peripheral part of the pixel circuits P on the substrate 101 of the display panel section 100. FIG. 4 is a diagram of assistance in explaining an operating point of an organic EL element and a driving transistor. FIGS. 5A to 5C are diagrams of assistance in explaining effects of variations in characteristics of the organic EL element and the driving transistor on a driving current Ids.

Figure 6:
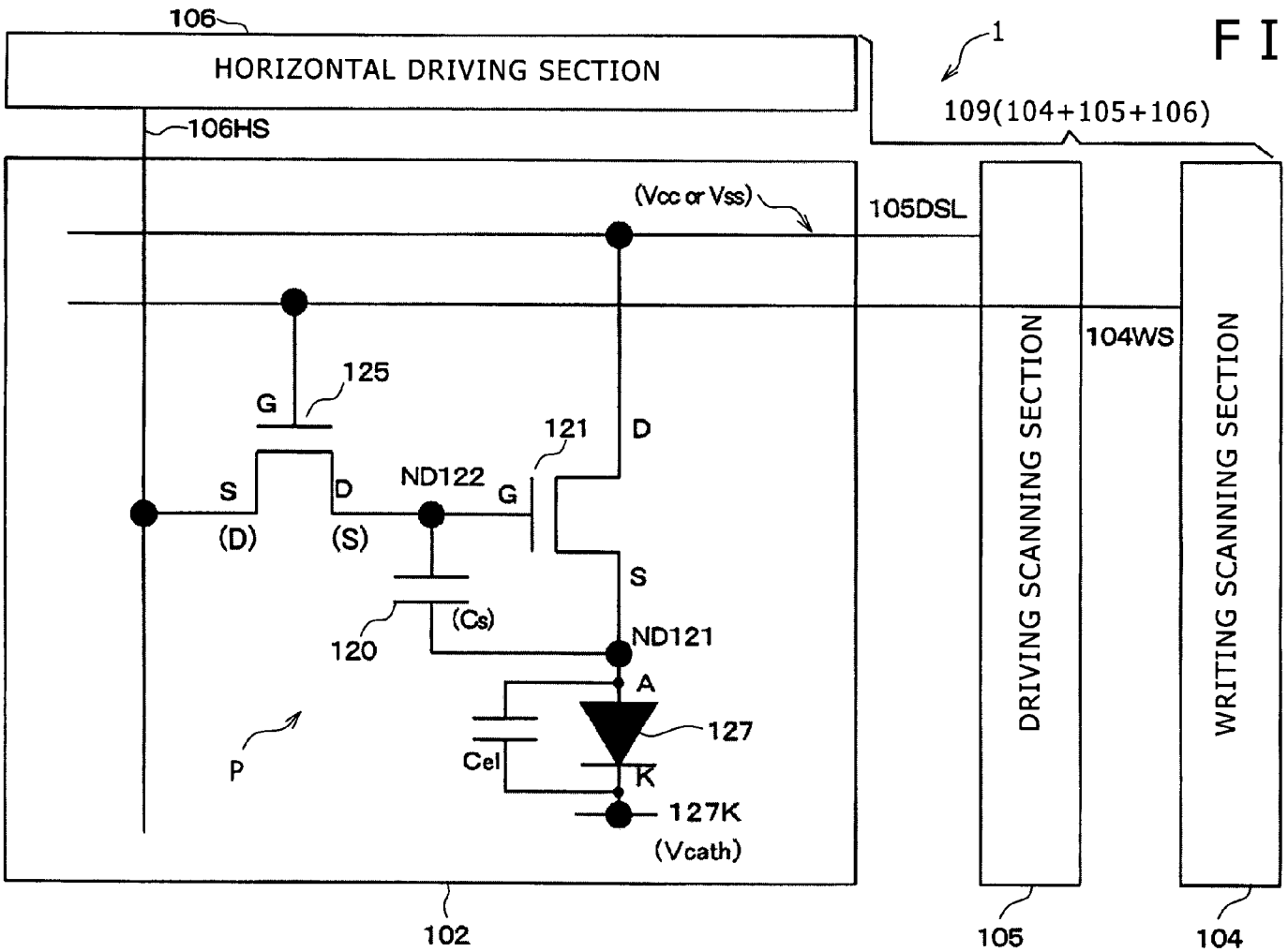
FIG. 6 is a diagram showing a third comparative example for the pixel circuits according to the present embodiment.

FIG. 6 is a diagram showing a third comparative example for the pixel circuits P according to the present embodiment. Incidentally, FIG. 6 also shows the vertical driving unit 103 and the horizontal driving section 106 disposed in the peripheral part of the pixel circuits P on the substrate 101 of the display panel section 100. An EL driving circuit in the pixel circuit P according to the present embodiment to be described later is based on an EL driving circuit including at least a storage capacitor 120 and a driving transistor 121 in a pixel circuit P according to the third comparative example. In this sense, it may safely be said that the pixel circuit P according to the third comparative example effectively has a similar circuit structure to that of the EL driving circuit in the pixel circuit P according to the present embodiment.

Pixel Circuit of Comparative Example

First Example

As shown in FIG. 2, the pixel circuit P according to the first comparative example is basically defined in that a driving transistor is formed by a p-type thin film field-effect transistor (TFT). In addition, the pixel circuit P according to the first comparative example employs a 3Tr driving configuration using two transistors for scanning in addition to the driving transistor.

Specifically, the pixel circuit P according to the first comparative example includes the p-type driving transistor 121, a p-type light emission controlling transistor 122 supplied with an active-L driving pulse, an n-type transistor 125 supplied with an active-H driving pulse, an organic EL element 127 as an example of an electrooptic element (light emitting element) that emits light by being fed with a current, and a storage capacitor (referred to also as a pixel capacitance) 120. Incidentally, a simplest circuit can employ a 2Tr driving configuration from which the light emission controlling transistor 122 is removed. In this case, the organic EL display device 1 employs a configuration from which the driving scanning section 105 is removed.

The driving transistor 121 supplies the organic EL element 127 with a driving current corresponding to a potential supplied to a gate terminal as a control input terminal of the driving transistor 121. The organic EL element 127 generally has a rectifying property, and is therefore represented by the symbol of a diode. Incidentally, the organic EL element 127 has a parasitic capacitance Cel. In FIG. 2, the parasitic capacitance Cel is shown in parallel with the organic EL element 127.

The sampling transistor 125 is a switching transistor disposed on the side of the gate terminal (control input terminal) of the driving transistor 121. The light emission controlling transistor 122 is also a switching transistor. Incidentally, in general, the sampling transistor 125 can be replaced with a p-type supplied with an active-L driving pulse. The light emission controlling transistor 122 can be replaced with an n-type supplied with an active-H driving pulse.

A pixel circuit P is disposed at an intersection of scanning lines 104WS and 105DS on a vertical driving side and a video signal line 106HS as a scanning line on a horizontal scanning side. The writing scanning line 104WS from the writing scanning section 104 is connected to the gate terminal of the sampling transistor 125. The driving scanning line 105DS from the driving scanning section 105 is connected to the gate terminal of the light emission controlling transistor 122.

The sampling transistor 125 has a source terminal S as a signal input terminal connected to the video signal line 106HS, and has a drain terminal D as a signal output terminal connected to the gate terminal G of the driving transistor 121. The storage capacitor 120 is disposed between a point of connection between the drain terminal D of the sampling transistor 125 and the gate terminal G of the driving transistor 121 and a second power supply potential Vc2 (which is for example a positive power supply voltage, and may be the same as a first power supply potential Vc1). As shown in parentheses, the source terminal S and the drain terminal D of the sampling transistor 125 can be interchanged with each other so that the drain terminal D is connected as a signal input terminal to the video signal line 106HS and the source terminal S is connected as a signal output terminal to the gate terminal G of the driving transistor 121.

The driving transistor 121, the light emission controlling transistor 122, and the organic EL element 127 are connected in series with each other in this order between the first power supply potential Vc1 (for example a positive power supply voltage) and a ground potential GND as an example of a reference potential. Specifically, the driving transistor 121 has a source terminal S connected to the first power supply potential Vc1, and has a drain terminal D connected to the source terminal S of the light emission controlling transistor 122. The drain terminal D of the light emission controlling transistor 122 is connected to the anode terminal A of the organic EL element 127. The cathode terminal K of the organic EL element 127 is connected to cathode common wiring 127K common to all pixels. The cathode common wiring 127K is set to the ground potential GND, for example. In this case, a cathode potential Vcath is also the ground potential GND.

Incidentally, as a simpler configuration, a simplest circuit can employ a 2Tr driving configuration formed by removing the light emission controlling transistor 122 in the configuration of the pixel circuit P shown in FIG. 2. In this case, the organic EL display device 1 employs a configuration from which the driving scanning section 105 is removed.

In either of the 3Tr driving shown in FIG. 2 and the 2Tr driving not shown in the figure, because the organic EL element 127 is a current light emitting element, a color gradation is obtained by controlling an amount of current flowing through the organic EL element 127. As such, the value of the current flowing through the organic EL element 127 is controlled by changing a voltage applied to the gate terminal of the driving transistor 121 and thereby changing a gate-to-source voltage Vgs retained by the storage capacitor 120. At this time, the potential of the video signal Vsig supplied from the video signal line 106HS (video signal line potential) is a signal potential. Incidentally, suppose that a signal amplitude indicating a gradation is ΔVin.

When the writing scanning line 104WS is set in a selected state by supplying the active-H writing driving pulse WS to the writing scanning line 104WS from the writing scanning section 104, and a signal potential is applied from the horizontal driving section 106 to the video signal line 106HS, the n-type transistor 125 conducts, the signal potential becomes the potential of the gate terminal of the driving transistor 121, and information corresponding to the signal amplitude ΔVin is written to the storage capacitor 120. A current flowing through the driving transistor 121 and the organic EL element 127 has a value corresponding to the gate-to-source voltage Vgs of the driving transistor 121, the gate-to-source voltage Vgs being retained by the storage capacitor 120, and the organic EL element 127 continues to emit light at a luminance corresponding to the value of the current. The operation of transmitting the video signal Vsig supplied to the video signal line 106HS to the inside of the pixel circuit P by selecting the writing scanning line 104WS is referred to as "writing" or "sampling." Once the signal is written, the organic EL element 127 continues to emit light at a fixed luminance until the signal is rewritten next.

In the pixel circuit P according to the first comparative example, the value of the current flowing through the organic EL element 127 is controlled by changing the applied voltage supplied to the gate terminal of the driving transistor 121 according to the signal amplitude ΔVin. At this time, the source terminal of the p-type driving transistor 121 is connected to the first power supply potential Vc1, and the driving transistor 121 typically operates in a saturation region.

Pixel Circuit of Comparative Example

Second Example

A pixel circuit P according to the second comparative example shown in FIG. 3 will next be described as a comparative example in describing characteristics of the pixel circuit P according to the present embodiment. The pixel circuit P according to the second comparative example (as with the present embodiment to be described later) is basically defined in that a driving transistor is formed by an n-type thin film field-effect transistor. When each transistor can be formed as an n-type rather than a p-type, an existing amorphous silicon (a-Si) process can be used in transistor production. Thereby, the transistor substrate can be reduced in cost. The development of pixel circuits P of such a constitution is anticipated.

The pixel circuit P according to the second comparative example is basically the same as the present embodiment to be described later in that a driving transistor is formed by an n-type thin film field-effect transistor. However, the pixel circuit P according to the second comparative example is not provided with a driving signal constancy achieving circuit for preventing effects of variation (variations and secular changes) in characteristics of the organic EL element 127 and the driving transistor 121 on the driving current Ids.

Specifically, the pixel circuit P according to the second comparative example is formed by simply replacing the p-type driving transistor 121 in the pixel circuit P according to the first comparative example with an n-type driving transistor 121 and arranging the light emission controlling transistor 122 and the organic EL element 127 on the source terminal side of the driving transistor 121. Incidentally, the light emission controlling transistor 122 is also replaced by an n-type. Of course, a simplest circuit can employ a 2Tr driving configuration from which the light emission controlling transistor 122 is removed.

In the pixel circuit P according to the second comparative example, irrespective of whether the light emission controlling transistor is provided or not, when the organic EL element 127 is driven, the drain terminal side of the driving transistor 121 is connected to the first power supply potential Vc1, and the source terminal of the driving transistor 121 is connected to the anode terminal side of the organic EL element 127, whereby a source follower circuit is formed as a whole.

<Relation to Iel-Vel Characteristic of Electrooptic Element>

Generally, as shown in FIG. 4, the driving transistor 121 is driven in a saturation region where the driving current Ids is constant irrespective of the gate-to-source voltage. Hence, letting Ids be the current flowing between the drain terminal and the source of the transistor operating in the saturation region, μ be mobility, W be channel width (gate width), L be channel length (gate length), Cox be gate capacitance (gate oxide film capacitance per unit area), and Vth be the threshold voltage of the transistor, the driving transistor 121 is a constant-current source having a value as shown in the following Equation (1). Incidentally, "^" denotes a power. As is clear from Equation (1), the drain current Ids of the transistor in the saturation region is controlled by the gate-to-source voltage Vgs, and the driving transistor 121 operates as a constant-current source.

$$Ids = \frac{1}{2}\mu\frac{W}{L}Cox(Vgs - Vth)\text{^}2 \quad (1)$$

However, the I-V characteristic of a current-driven type light emitting element including the organic EL element generally changes with the passage of time as shown in FIG. 5A. In the current-voltage (Iel-Vel) characteristics of a current-driven type light emitting element typified by the organic EL element shown in FIG. 5A, a curve shown as a solid line indicates a characteristic at a time of an initial state, and a curve shown as a broken line indicates a characteristic after a secular change.

For example, when a light emission current Iel flows through the organic EL element 127 as an example of a light emitting element, a voltage between the anode and the cathode of the organic EL element 127 is uniquely determined. However, as shown in FIG. 5A, during an emission period, the light emission current Iel determined by the drain-to-source current Ids (=driving current Ids) of the driving transistor 121 flows through the anode terminal of the organic EL element 127, and thereby rises by an amount corresponding to the anode-to-cathode voltage Vel of the organic EL element 127.

In the pixel circuit P according to the first comparative example shown in FIG. 2, effect of the rise corresponding to the anode-to-cathode voltage Vel of the organic EL element 127 appears on the drain terminal side of the driving transistor 121. However, because the driving transistor 121 performs constant-current driving by operating in the saturation region, a constant current Ids flows through the organic EL element 127, and a secular change does not occur in the light emission luminance of the organic EL element 127 even when the Iel-Vel characteristic of the organic EL element 127 changes.

The configuration of the pixel circuit P in the connection mode shown in FIG. 2 which pixel circuit includes the driving transistor 121, the light emission controlling transistor 122, the storage capacitor 120, and the sampling transistor 125 has a driving signal constancy achieving circuit formed therein for holding the driving current constant by correcting a change in the current-voltage characteristic of the organic EL element 127 as an example of an electrooptic element. That is, when the pixel circuit P is driven by the video signal Vsig, the source terminal of the p-type driving transistor 121 is connected to the first power supply potential Vc1, and the p-type driving transistor 121 is designed to operate in the saturation region at all times. Therefore the p-type driving transistor 121 is a constant-current source having the value as shown in Equation (1).

In the pixel circuit P according to the first comparative example, the voltage of the drain terminal of the driving transistor 121 changes with a secular change in the Iel-Vel characteristic of the organic EL element 127 (FIG. 5A). However, because the gate-to-source voltage Vgs of the driving transistor 121 is held constant in principle by the bootstrap function of the storage capacitor 120, the driving transistor 121 operates as a constant-current source. As a result, a constant amount of current flows through the organic EL element 127, and the organic EL element 127 can be made to emit light at a constant luminance, so that the light emission luminance is unchanged.

Also in the pixel circuit P according to the second comparative example, the potential of the source terminal (source potential Vs) of the driving transistor 121 is determined by the operating point of the driving transistor 121 and the organic EL element 127, and the driving transistor 121 is driven in the saturation region. The driving transistor 121 therefore feeds the driving current Ids having the current value defined in the above-described Equation (1) in relation to the gate-to-source voltage Vgs corresponding to the source voltage of the operating point.

However, in the simple circuit (pixel circuit P according to the second comparative example) formed by changing the p-type driving transistor 121 in the pixel circuit P according to the first comparative example to an n-type, the source terminal is connected to the side of the organic EL element 127. As a result, according to the Iel-Vel characteristic of the organic EL element 127 which characteristic changes with the passage of time as shown in FIG. 5A described above, the anode-to-cathode voltage Vel for the same light emission current Iel changes from Vel1 to Vel2, whereby the operating point of the driving transistor 121 is changed, and the source potential Vs of the driving transistor 121 is changed even when the same gate potential Vg is applied. Thereby the gate-to-source voltage Vgs of the driving transistor 121 is changed. As is clear from Characteristic Equation (1), when the gate-to-source voltage Vgs is varied, the driving current Ids is varied even when the gate potential Vg is constant. The variation in driving current Ids due to this cause appears as a variation or a secular change in light emission luminance of each pixel circuit P, thus causing degradation in image quality.

On the other hand, as will be described later in detail, even in the case of using the n-type driving transistor 121, a circuit configuration and driving timing for realizing a bootstrap function that makes the potential Vg of the gate terminal of the driving transistor 121 interlocked with variation in the potential Vs of the source terminal of the driving transistor 121 can vary the gate potential Vg so as to cancel variation in anode potential of the organic EL element 127 (that is, variation in source potential of the driving transistor 121) due to a secular change in the characteristic of the organic EL element 127 even when the variation in anode potential of the organic EL element 127 occurs. Thereby, the uniformity of screen luminance can be ensured. The bootstrap function can improve the capability of correcting secular variation of a current-driven type light emitting element typified by the organic EL element. Of course, this bootstrap function operates when the source potential Vs of the driving transistor 121 varies with variation in the anode-to-cathode voltage Vel in a process of the light emission current Iel starting flowing through the organic EL element 127 at a time of a start of light emission and thereby the anode-to-cathode voltage Vel rising until the anode-to-cathode voltage Vel becomes stable.

<Relation to Vgs-Ids Characteristic of Driving Transistor>

Although the characteristics of the driving transistor 121 are not regarded as a particular problem in the first and second comparative examples, when a characteristic of the driving transistor 121 differs in each pixel, the characteristic affects the driving current Ids flowing through the driving transistor 121. As an example, as is understood from Equation (1), when the mobility μ or the threshold voltage Vth varies or changes with the passage of time between pixels, a variation or a secular change occurs in the driving current Ids flowing through the driving transistor 121 even when the gate-to-source voltage Vgs is the same, and thus the light emission luminance of the organic EL element 127 changes in each pixel.

For example, there are variations in characteristics such as the threshold voltage Vth, the mobility μ and the like in each pixel circuit P due to variations in a manufacturing process of the driving transistor 121. Even in the case where the driving transistor 121 is driven in the saturation region, the drain current (driving current Ids) varies in each pixel circuit P due to the characteristic variations even when a same gate potential is supplied to the driving transistor 121, and the variation in the drain current appears as variation in light emission luminance.

As described above, the drain current Ids when the driving transistor 121 is operating in the saturation region is expressed by Characteristic Equation (1). Directing attention to variation in threshold voltage of the driving transistor 121, as is clear from Characteristic Equation (1), a variation in the threshold voltage Vth varies the drain current Ids even when the gate-to-source voltage Vgs is constant. In addition, directing attention to variation in mobility of the driving transistor 121, as is clear from Characteristic Equation (1), a variation in the mobility μ varies the drain current Ids even when the gate-to-source voltage Vgs is constant.

When a large difference in the Vgs-Ids characteristic thus occurs due to difference in threshold voltage Vth or mobility μ, the driving current Ids is varied and the light emission luminance becomes different even when the same signal amplitude ΔVin is given. Therefore the uniformity of screen luminance may not be obtained. On the other hand, driving timing for realizing a threshold value correcting function and a mobility correcting function (details will be described later) can suppress effects of these variations, and ensure the uniformity of screen luminance.

In threshold value correcting operation and mobility correcting operation adopted in the present embodiment, when a writing gain is assumed to be one (ideal value), the gate-to-source voltage Vgs at a time of light emission is set so as to be expressed by "ΔVin+Vth−ΔV," whereby the drain-to-source current Ids is not dependent on variation or change in the threshold voltage Vth and is not dependent on variation or change in the mobility μ. As a result, even when the threshold voltage Vth or the mobility μ varies due to a manufacturing process or with the passage of time, the driving current Ids is not varied, and the light emission luminance of the organic EL element 127 is not varied either. At a time of mobility correction, negative feedback is applied such that a mobility correcting parameter ΔV1 is increased for a high mobility μ1, whereas a mobility correcting parameter ΔV2 is decreased for a low mobility μ2. In this sense, the mobility correcting parameter ΔV is referred to also as an amount of negative feedback ΔV.

Pixel Circuit of Comparative Example

Third Example

The pixel circuit P according to the third comparative example shown in FIG. 6, on which circuit the pixel circuit P according to the present embodiment is based, employs a driving system that incorporates a circuit (bootstrap circuit) for preventing variation in driving current due to a secular change of the organic EL element 127 in the pixel circuit P according to the second comparative example shown in FIG. 3, and which driving system prevents variation in driving current due to variation in the characteristics of the driving transistor 121 (variations in threshold voltage and variations in mobility).

As with the pixel circuit P according to the second comparative example, the pixel circuit P according to the third comparative example uses an n-type driving transistor 121. In addition, the pixel circuit P according to the third comparative example is defined in that the pixel circuit P according to the third comparative example has a circuit for suppressing variation in driving current Ids to the organic EL element due to a secular change of the organic EL element, that is, a driving signal constancy achieving circuit for holding the driving current Ids constant by correcting a change in the current-voltage characteristic of the organic EL element as an example of an electrooptic element. Further, the pixel circuit P according to the third comparative example is defined in that the pixel circuit P according to the third comparative example has a function of making the driving current constant even when a secular change occurs in the current-voltage characteristic of the organic EL element.

That is, the pixel circuit P according to the third comparative example is defined in that the pixel circuit P according to the third comparative example employs a 2TR driving configuration using one switching transistor (sampling transistor 125) for scanning in addition to the driving transistor 121, and prevents effects of a secular change of the organic EL element 127 and variations in the characteristics of the driving transistor 121 (for example variations and changes in threshold voltage and mobility) on the driving current Ids by setting on/off timing (switching timing) of a power driving pulse DSL and a writing driving pulse WS for controlling each switching transistor. The 2TR driving configuration as well as a small number of elements and a small number of pieces of wiring makes it possible to achieve higher definition.

The pixel circuit P according to the third comparative example greatly differs from the second comparative example shown in FIG. 3 in terms of configuration in that the connection mode of a storage capacitor 120 is modified to form a bootstrap circuit, which is an example of a driving signal constancy achieving circuit, as a circuit for preventing variation in driving current due to a secular change of the organic EL element 127. A provision is made by devising the driving timing of the transistors 121 and 125 as a method of suppressing effects of variations in the characteristics of the driving transistor 121 (for example variations and changes in threshold voltage and mobility) on the driving current Ids.

Specifically, the pixel circuit P according to the third comparative example includes the storage capacitor 120, the n-type driving transistor 121, the n-type transistor 125 supplied with an active-H (high) writing driving pulse WS, and the organic EL element 127 as an example of an electrooptic element (light emitting element) that emits light by being fed with a current.

The storage capacitor 120 is connected between the gate terminal (node ND122) and the source terminal of the driving transistor 121. The source terminal of the driving transistor 121 is directly connected to the anode terminal of the organic EL element 127. The storage capacitor 120 also functions as a bootstrap capacitance. As in the first comparative example and the second comparative example, the cathode terminal of the organic EL element 127 is connected to cathode common wiring 127K common to all pixels, and is supplied with a cathode potential Vcath (for example a ground potential GND).

The drain terminal of the driving transistor 121 is connected to a power supply line 105DSL from a driving scanning section 105 functioning as a power supply scanner. The power supply line 105DSL is defined in that the power supply line 105DSL itself has a capability of supplying power to the driving transistor 121.

Specifically, the driving scanning section 105 has a power supply voltage changing circuit for selecting each of a first potential Vcc on a high voltage side corresponding to a power supply voltage and a second potential Vss on a low voltage side, and supplying the potential to the drain terminal of the driving transistor 121.

Suppose that the second potential Vss is sufficiently lower than the offset potential Vofs (referred to also as a reference potential) of a video signal Vsig in a video signal line 106HS. Specifically, the second potential Vss on the low potential side of the power supply line 105DSL is set such that the gate-to-source voltage Vgs (a difference between a gate potential Vg and a source potential Vs) of the driving transistor 121 is larger than the threshold voltage Vth of the driving transistor 121. Incidentally, the offset potential Vofs is used for initializing operation prior to threshold value correcting operation, and is also used to precharge the video signal line 106HS.

The sampling transistor 125 has a gate terminal connected to a writing scanning line 104WS from a writing scanning section 104, has a drain terminal connected to the video signal line 106HS, and has a source terminal connected to the gate terminal (node ND122) of the driving transistor 121. The gate terminal of the sampling transistor 125 is supplied with the active-H writing driving pulse WS from the writing scanning section 104.

The sampling transistor 125 can be in a connection mode in which the source terminal and the drain terminal are interchanged with each other. In addition, either of a depletion type and an enhancement type can be used as the sampling transistor 125.

Operation of Pixel Circuit

Third Comparative Example

Figure 7:
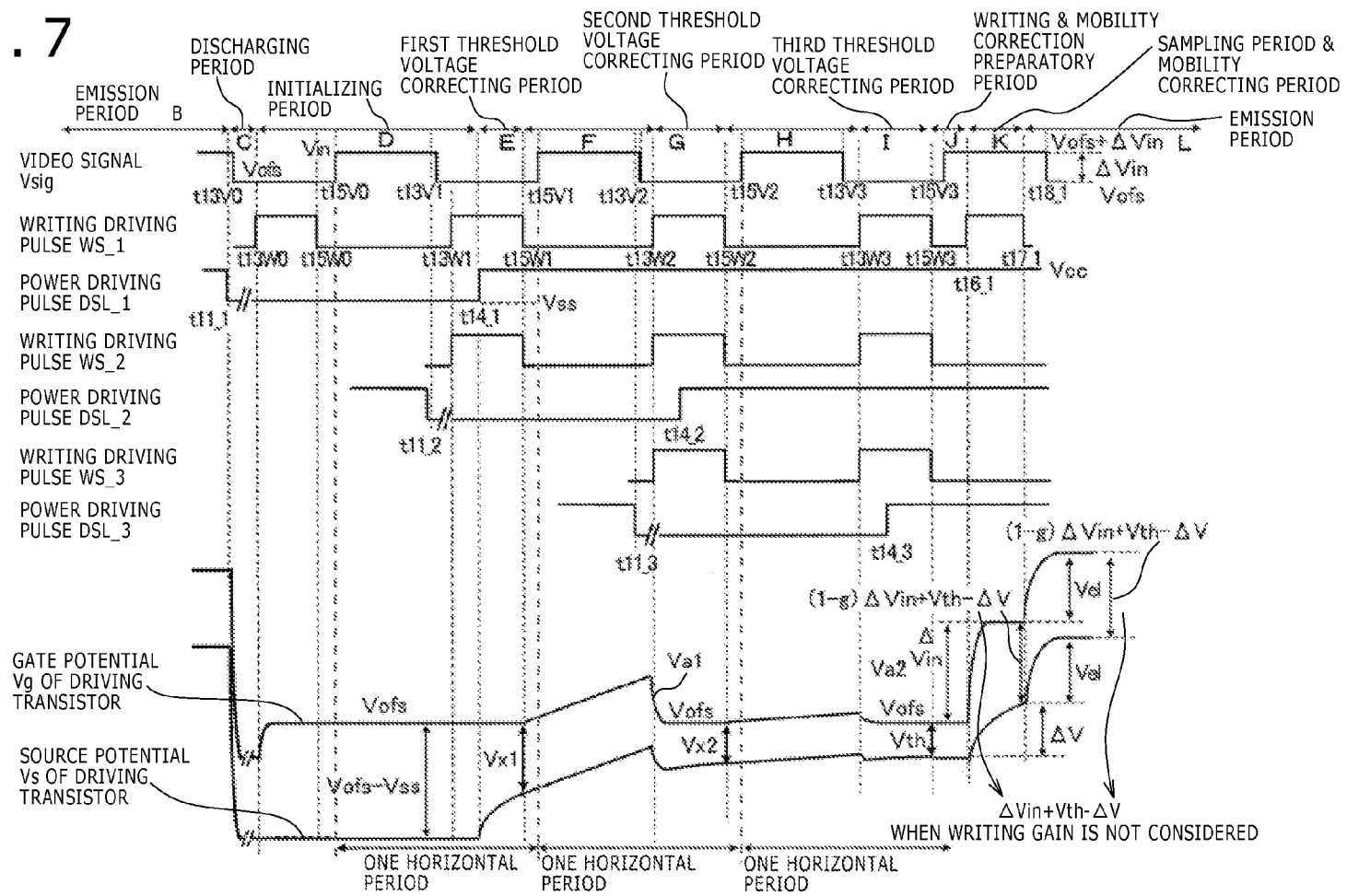
FIG. 7 is a timing chart of assistance in explaining a basic example of driving timing according to the third comparative example of a pixel circuit according to the third comparative example shown in FIG. 6.

FIG. 7 is a timing chart of assistance in explaining a basic example of driving timing according to the third comparative example of the pixel circuit P according to the third comparative example shown in FIG. 6. FIG. 7 represents a case of line-sequential driving. FIG. 7 shows changes in potential of the writing scanning line 104WS, changes in potential of the power supply line 105DSL, and changes in potential of the video signal line 106HS on a common time axis. FIG. 7 also shows changes in the gate potential Vg and the source potential Vs of the driving transistor 121 for one row (first row in the figure) in parallel with these potential changes.

Except for the voltage setting of the power driving pulse DSL (the drain voltage Vd_121), the idea of the driving timing according to the third comparative example shown in FIG. 7 is applied also to the present embodiment to be described later. Incidentally, FIG. 7 shows a basic example for realizing a threshold value correcting function, a mobility correcting function, and a bootstrap function in the pixel circuit P according to the third comparative example. The driving timing for realizing the threshold value correcting function, the mobility correcting function, and the bootstrap function is not limited to the mode shown in FIG. 7, but various modifications can be made. The mechanism of each embodiment to be described later is applicable even with the driving timings of these various modifications.

The driving timing shown in FIG. 7 corresponds to the case of line-sequential driving. The writing driving pulse WS, the power driving pulse DSL, and the video signal Vsig for one row are handled as one set, and the timing (phase relation in particular) of the signals is controlled independently in a row unit. When the row is changed, the timing is shifted by one H (H is a horizontal scanning period).

In the following, to facilitate description and understanding, description will be made by briefly describing for example the writing, retaining, or sampling of information of signal amplitude ΔVin in the storage capacitor 120 assuming that a writing gain is one (ideal value) unless otherwise specified. When the writing gain is less than one, information corresponding to the magnitude of the signal amplitude ΔVin and multiplied by the gain, rather than the magnitude itself of the signal amplitude ΔVin, is retained in the storage capacitor 120.

Incidentally, the ratio of the magnitude of the information corresponding to the signal amplitude ΔVin and written to the storage capacitor 120 is referred to as a writing gain Ginput. Specifically, in a capacitive series circuit of a total capacitance C1 disposed in parallel with the storage capacitor 120 in terms of an electric circuit and including a parasitic capacitance and a total capacitance C2 disposed in series with the storage capacitor 120 in terms of an electric circuit, the writing gain Ginput relates to an amount of charge distributed to the capacitance C1 when the signal amplitude ΔVin is supplied to the capacitive series circuit. When expressed by an equation, letting g=C1/(C1+C2), Writing Gain Ginput=C2/(C1+C2)=1−C1/(C1+C2)=1−g. In the following, the writing gain is taken into consideration in a description in which "g" appears.

In addition, to facilitate description and understanding, description will be made briefly assuming that a bootstrap gain is one (ideal value) unless otherwise specified. Incidentally, a ratio of a rise in the gate potential Vg to a rise in the source potential Vs when the storage capacitor 120 is disposed between the gate and the source of the driving transistor 121 is referred to as a bootstrap gain (bootstrap operation capability) Gbst. The bootstrap gain Gbst specifically relates to the capacitance value Cs of the storage capacitor 120, the capacitance value Cgs of a parasitic capacitance C121*gs* formed between the gate and the source of the driving transistor 121, the capacitance value Cgd of a parasitic capacitance C121*gd* formed between the gate and the drain of the driving transistor 121, and the capacitance value Cws of a parasitic capacitance C125*gs* formed between the gate and the source of the sampling transistor 125. When expressed by an equation, Bootstrap Gain Gbst=(Cs+Cgs)/(Cs+Cgs+Cgd+Cws).

In the driving timing according to the third comparative example, a period in which the video signal Vsig is at the offset potential Vofs, which period is an ineffective period, is set in a first half of one horizontal scanning period, and a period in which the video signal Vsig is at the signal potential Vin (=Vofs+ΔVin), which period is an effective period, is set in a second half of one horizontal scanning period. In addition, threshold value correcting operation is repeated a plurality of times (three times in FIG. 7) in each horizontal period as a combination of the effective period and the ineffective period of the video signal Vsig. The timing of changing between the effective period and the ineffective period of the video signal Vsig for each of the times (t13V and t15V) and the timing of changing between an active state and an inactive state of the writing driving pulse WS (t13W and t15W) are distinguished by indicating each time by a reference element without "_."

First, in the emission period B of the organic EL element 127, the power supply line 105DSL is at the first potential Vcc, and the sampling transistor 125 is in an off state. At this time, because the driving transistor 121 is set to operate in the saturation region, the driving current Ids flowing through the organic EL element 127 assumes a value shown in Equation (1) according to the gate-to-source voltage Vgs of the driving transistor 121.

Next, when the non-emission period begins, in a first discharging period C, the power supply line 105DSL is changed to the second potential Vss. At this time, when the second potential Vss is smaller than a sum of the threshold voltage Vthel and the cathode potential Vcath of the organic EL element 127, that is, when "Vss<Vthel+Vcath," the organic EL element 127 is quenched, and the power supply line 105DSL is on the source side of the driving transistor 121. At this time, the anode of the organic EL element 127 is charged to the second potential Vss.

Further, in an initializing period D, the sampling transistor 125 is turned on when the video signal line 106HS is changed to the offset potential Vofs, so that the gate potential of the driving transistor 121 is set to the offset potential Vofs. At this time, the gate-to-source voltage Vgs of the driving transistor 121 assumes a value "Vofs−Vss." The threshold value correcting operation may not be performed unless "Vofs−Vss" is larger than the threshold voltage Vth of the driving transistor 121. It is therefore necessary that "Vofs−Vss>Vth."

When a first threshold voltage correcting period E thereafter begins, the power supply line 105DSL is changed to the first potential Vcc again. By changing the power supply line 105DSL (that is, power supply voltage to the driving transistor 121) to the first potential Vcc, the anode of the organic EL element 127 becomes the source of the driving transistor 121, and a driving current Ids flows from the driving transistor 121. Because an equivalent circuit of the organic EL element 127 is represented by a diode and a capacitance, letting Vel be an anode potential of the organic EL element 127 with respect to the cathode potential Vcath of the organic EL element 127, as long as "Vel≤Vcath+Vthel," that is, as long as a leakage current of the organic EL element 127 is considerably smaller than the current flowing through the driving transistor 121, the driving current Ids of the driving transistor 121 is used to charge the storage capacitor 120 and the parasitic capacitance Cel of the organic EL element 127. At this time, the anode voltage Vel of the organic EL element 127 rises with time.

The sampling transistor 125 is turned off after the passage of a certain time. At this time, when the gate-to-source voltage Vgs of the driving transistor 121 is larger than the threshold voltage Vth (that is, when threshold value correction is not completed), the driving current Ids of the driving transistor 121 continues flowing so as to charge the storage capacitor 120, and the gate-to-source voltage Vgs of the driving transistor 121 rises. At this time, a reverse bias is applied to the organic EL element 127, and therefore the organic EL element 127 does not emit light.

Further, in a second threshold voltage correcting period G, the sampling transistor 125 is turned on when the video signal line 106HS is changed to the offset potential Vofs again. Thereby, the gate potential of the driving transistor 121 is set to the offset potential Vofs, and the threshold value correcting operation is started again. As a result of repeating this operation, the gate-to-source voltage Vgs of the driving transistor 121 eventually assumes the value of the threshold voltage Vth. At this time, "Vel=Vofs−Vth≤Vcath+Vthel."

Incidentally, in the example of operation of the third comparative example, to make the storage capacitor 120 surely retain the voltage corresponding to the threshold voltage Vth of the driving transistor 121 by repeatedly performing threshold value correcting operation, the threshold value correcting operation is repeated a plurality of times while maintaining a state of the drain voltage Vd_121 of the driving transistor 121 being set at the first potential Vcc and a current flowing, with one horizontal scanning period (1H period) as a process cycle. However, in principle, this repeated operation is not essential. The threshold value correcting operation may be performed only once when one time of threshold value correcting operation is sufficient. However, as is understood from the figure, unlike the case of the 5TR configuration shown in Patent Document 1, a threshold value correcting period for each time of threshold value correcting operation in the operation of the third comparative example is limited to the period of the offset potential Vofs rather than one H, and is about ½ of one H in the present example. It is probable that the threshold value correcting period is less sufficient than in the case of the 5TR configuration. From such a viewpoint, it is considered that a degree of need for performing threshold value correcting operation a plurality of times with one horizontal scanning period as process cycle is increased when the pixel circuit P and the driving method thereof as in the third comparative example are employed.

One horizontal scanning period is a process cycle of threshold value correcting operation because the threshold value correcting operation is performed to make the storage capacitor 120 retain the voltage corresponding to the threshold voltage Vth of the driving transistor 121 by making the sampling transistor 125 conduct in a time period in which the potential of the power supply line 105DSL is the first potential Vcc and the video signal line 106HS is at the offset potential Vofs after performing an initializing operation of setting the potential of the power supply line 105DSL to the second potential Vss, setting the gate of the driving transistor 121 to the offset potential Vofs, and further setting the source potential to the second potential Vss prior to the threshold value correcting operation before the sampling transistor 125 samples the information of the signal amplitude ΔVin in the storage capacitor 120 in each row.

The threshold value correcting period is inevitably shorter than one horizontal scanning period. Hence, there may be a case where an accurate voltage corresponding to the threshold voltage Vth cannot be entirely retained in the storage capacitor 120 in this short threshold value correcting operation period for one time of threshold value correcting operation due to the capacitance Cs of the storage capacitor 120, the magnitude relation of the second potential Vss, and other factors. In the third comparative example, threshold value correcting operation is performed a plurality of times to deal with this. That is, threshold value correcting operation is repeatedly performed in a plurality of horizontal periods prior to the sampling of the information of the signal amplitude ΔVin into the storage capacitor 120 (signal writing), whereby the voltage corresponding to the threshold voltage Vth of the driving transistor 121 is surely retained by the storage capacitor 120. A threshold value correcting process performed a plurality of times with one horizontal scanning period as one process cycle of threshold value correcting operation will hereinafter be referred to as a "1H-unit divided threshold value correcting process" or a "divided threshold value correcting process."

After the threshold value correcting operation is completed (after a third threshold voltage correcting period I in the present example), the sampling transistor 125 is turned off, and a writing & mobility correction preparatory period J begins. When the video signal line 106HS is changed to the signal potential Vin (=Vofs+ΔVin), the sampling transistor 125 is turned on again to begin a sampling period & mobility correcting period K. The signal amplitude ΔVin is a value corresponding to a gradation. While the gate potential of the driving transistor 121 becomes the signal potential Vin (=Vofs+ΔVin) because the sampling transistor 125 is on, the drain terminal of the driving transistor 121 is at the first potential Vcc, and the driving current Ids flows, so that the source potential Vs rises with time. In FIG. 7, the amount of the rise is represented by ΔV.

At this time, when the source voltage Vs does not exceed a sum of the threshold voltage Vthel and the cathode potential Vcath of the organic EL element 127, that is, when a leakage current of the organic EL element 127 is considerably smaller than the current flowing through the driving transistor 121, the driving current Ids of the driving transistor 121 is used to charge the storage capacitor 120 and the parasitic capacitance Cel of the organic EL element 127.

At this point in time, the operation of correcting the threshold value of the driving transistor 121 is completed, and therefore the current fed by the driving transistor 121 reflects mobility μ. Specifically, when the mobility μ is high, the amount of current at this time is large, and the source rises rapidly. When the mobility μ is low, on the other hand, the amount of current is small, and the source rises slowly. Thereby, the gate-to-source voltage Vgs of the driving transistor 121 is reduced reflecting the mobility μ, and becomes a gate-to-source voltage Vgs that completely corrects the mobility μ after the passage of a certain time.

Thereafter an emission period L begins. The sampling transistor 125 is turned off to end writing, and the organic EL element 127 is allowed to emit light. Because the gate-to-source voltage Vgs of the driving transistor 121 is constant due to the bootstrap effect of the storage capacitor 120, the driving transistor 121 feeds a constant current (driving current Ids) to the organic EL element 127. The anode potential Vel of the organic EL element 127 rises to a voltage Vx at which a current as driving current Ids flows through the organic EL element 127, so that the organic EL element 127 emits light.

Also in the pixel circuit P according to the third comparative example, the I-V characteristic of the organic EL element 127 changes as light emission time is lengthened. Therefore the potential of a node ND121 (that is, the source potential Vs of the driving transistor 121) is also changed. However, because the gate-to-source voltage Vgs of the driving transistor 121 is maintained at a constant value by the bootstrap effect of the storage capacitor 120, the current flowing through the organic EL element 127 is not changed. Hence, even when the I-V characteristic of the organic EL element 127 is degraded, the constant current (driving current Ids) continues flowing through the organic EL element 127 at all times, and the luminance of the organic EL element 127 is not changed.

The relation of the driving current Ids to the gate voltage Vgs can be expressed as in Equation (2-1) by substituting "ΔVin−ΔV+Vth" for Vgs in the foregoing Equation (1) expressing a transistor characteristic. Incidentally, when the writing gain is taken into consideration, the relation of the driving current Ids to the gate voltage Vgs can be expressed as in Equation (2-2) by substituting "(1−g)ΔVin−ΔV+Vth" for Vgs in Equation (1). In Equation (2-1) and Equation (2-2) (referred to collectively as Equation (2)), k=(½)(W/L)Cox.

$$\left.\begin{aligned} Ids &= k\mu(Vgs - Vth)\text{^}2 = k\mu(\Delta Vin - \Delta V)\text{^}2 \quad (2\text{-}1) \\ Ids &= k\mu(Vgs - Vth)\text{^}2 = k\mu((1-g)\Delta Vin - \Delta V)\text{^}2 \quad (2\text{-}2) \end{aligned}\right\} \quad (2)$$

This Equation (2) shows that the term of the threshold voltage Vth is cancelled, and that the driving current Ids supplied to the organic EL element 127 is not dependent on the threshold voltage Vth of the driving transistor 121. The driving current Ids is basically determined by the signal amplitude ΔVin (sampling voltage=Vgs retained by the storage capacitor 120 in correspondence with the signal amplitude ΔVin, to be exact). In other words, the organic EL element 127 emits light at a luminance corresponding to the signal amplitude ΔVin.

At this time, the information retained by the storage capacitor 120 is corrected by the amount of the rise ΔV in source potential Vs. The amount of the rise ΔV acts exactly to cancel the effect of the mobility μ positioned in a coefficient part of Equation (2). The amount of correction ΔV for the mobility μ of the driving transistor 121 is added to the signal written to the storage capacitor 120. The direction of the amount of correction ΔV is actually a negative direction. In this sense, the amount of the rise ΔV is referred to also as a mobility correcting parameter ΔV or an amount of negative feedback ΔV.

The driving current Ids flowing through the organic EL element 127 is in effect dependent on only the signal amplitude ΔVin with variations in the threshold voltage Vth and mobility μ of the driving transistor 121 cancelled. Because the driving current Ids is not dependent on the threshold voltage Vth and the mobility μ, the driving current Ids between the drain and the source is not varied and the light emission luminance of the organic EL element 127 is not varied either even when the threshold voltage Vth or the mobility μ varies due to a manufacturing process or changes with the passage of time.

In addition, by connecting the storage capacitor 120 between the gate and the source of the driving transistor 121, even in the case of using the n-type driving transistor 121, a circuit configuration and driving timing for realizing a bootstrap function that makes the potential Vg of the gate terminal of the driving transistor 121 interlocked with variation in the potential Vs of the source terminal of the driving transistor 121 are set so that the gate potential Vg can be varied so as to cancel variation in anode potential of the organic EL element 127 (that is, variation in source potential of the driving transistor 121) due to a secular change in the characteristic of the organic EL element 127 even when the variation in anode potential of the organic EL element 127 occurs.

Thereby, effect of secular change in characteristic of the organic EL element 127 is eased, and the uniformity of screen luminance can be ensured. The bootstrap function of the storage capacitor 120 between the gate and the source of the driving transistor 121 can improve the capability of correcting a secular variation of a current-driven type light emitting element typified by the organic EL element. Of course, the bootstrap function operates also when the source potential Vs of the driving transistor 121 varies with variation in the anode-to-cathode voltage Vel in a process of the light emission current Iel starting flowing through the organic EL element 127 at a time of a start of light emission and thereby the anode-to-cathode voltage Vel rising until the anode-to-cathode voltage Vel becomes stable.

Thus, according to the pixel circuit P according to the third comparative example (in effect as with the pixel circuit P according to the present embodiment to be described later) and the driving timing of the controlling section 109 configured to drive the pixel circuit P, even when there occur variations (variations and secular changes) in characteristics of the driving transistor 121 or the organic EL element 127, these variations are corrected, thereby preventing effects of the variations from appearing on a display screen. Therefore high-quality image display without changes in luminance can be made.

<Problem of 1H-Unit Divided Threshold Value Correcting Process>

Figure 8:
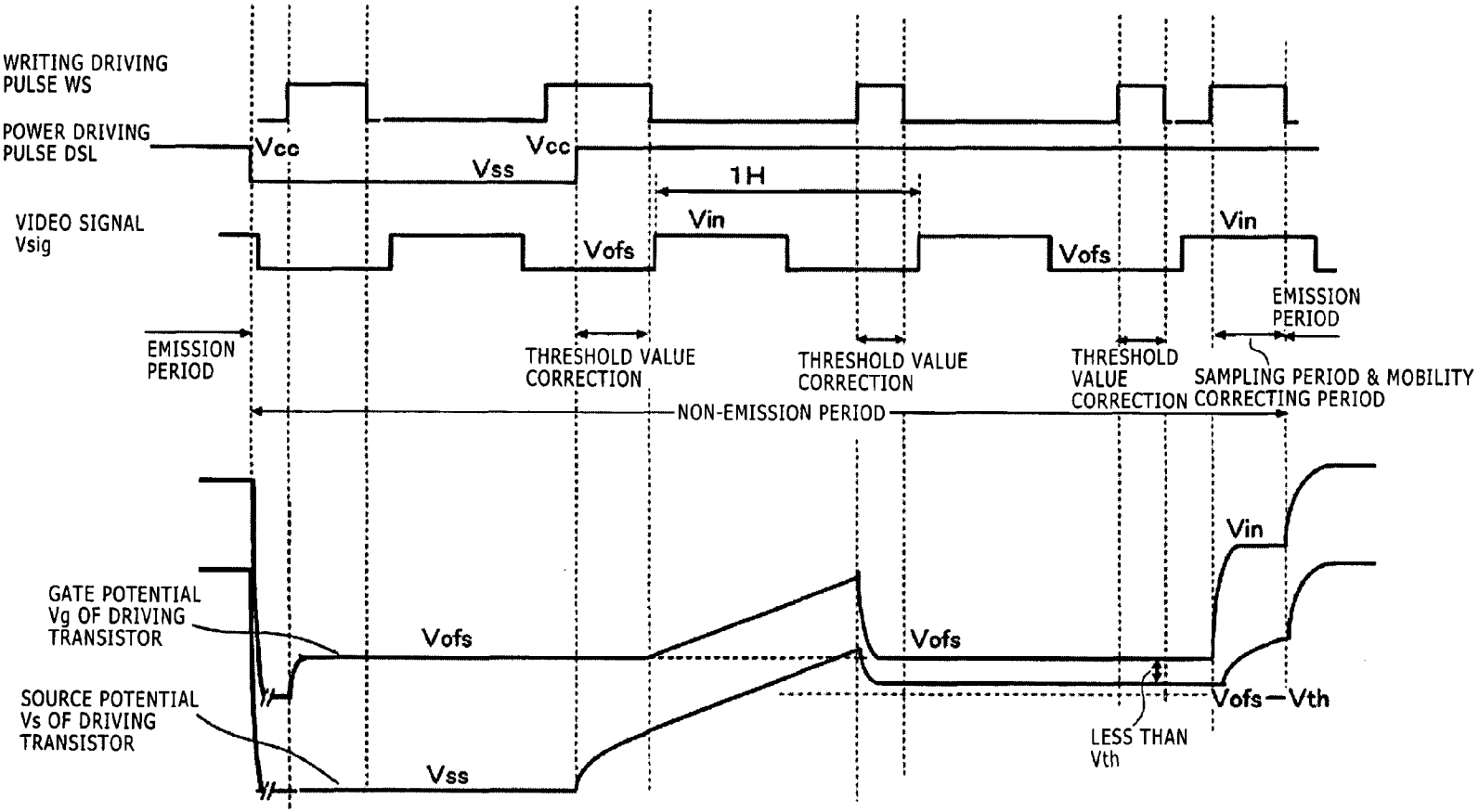
FIG. 8 is a diagram of assistance in explaining a problem of a 1H-unit divided threshold value correcting process.

FIG. 8 is a diagram of assistance in explaining a problem of the 1H-unit divided threshold value correcting process. As shown in FIG. 7, in the case of the "1H-unit divided threshold value correcting process" in which threshold value correcting operation is performed a plurality of times while maintaining a state of the drain voltage Vd_121 of the driving transistor 121 being set at the first potential Vcc and a current flowing with one horizontal scanning period as one process cycle, in an interval period between threshold value correcting process periods (which interval period is a period of the signal potential Vin from a period when the signal line potential is the offset potential Vofs for threshold value correction to a change to the next offset potential Vofs, and will be referred to as a threshold value correcting operation interval), the sampling transistor 125 is turned off as described above, and correction of the threshold value of the driving transistor 121 is not made completely, so that the gate-to-source voltage Vgs_121 of the driving transistor 121 is larger than the threshold voltage Vth.

During the threshold value correcting operation interval, the gate-to-source voltage Vgs_121 is larger than the threshold voltage Vth, a current flows through the driving transistor 121, and the source potential Vs_121 and the gate potential Vg_121 rise in a state of the gate-to-source voltage Vgs_121 at that point in time being maintained. In this case, when threshold value correcting time is short or the time of the threshold value correcting operation interval is long, as shown in FIG. 8, the source potential Vs_121 of the drive transistor 121 rises greatly during the threshold value correcting operation interval. As a result, when threshold value correction is made again in a next threshold value correcting process period in the 1H-unit divided threshold value correcting process, the voltage across the storage capacitor 120, that is, the gate-to-source voltage Vgs_121 of the driving transistor 121 is less than the threshold voltage Vth_121. Thereafter, no current flows through the driving transistor 121, and threshold value correcting operation is not performed normally (which will be referred to as a "phenomenon of failure of threshold value correction"), which results in nonuniformity or stripes appearing in a display image. For example, when high-speed driving is performed, this problem occurs noticeably because the time of one horizontal scanning period is shortened and a time taken to make threshold value correction is also reduced.

<Improving Method: Basic Principle>

In view of causes of the phenomenon of failure of threshold value correction, it is important for example to suppress a rise in the source potential Vs_121 of the driving transistor 121 during the threshold value correcting operation interval as a period during which the signal line potential is the signal potential Vin between the offset potential Vofs for threshold value correction and the next offset potential Vofs and to make the source potential Vs_121 rise rapidly during threshold value correcting operation in each threshold value correcting process period. Both of the objects relate to the rising speed of the source potential Vs_121, and it is therefore considered that measures can be taken from substantially similar viewpoints.

Because a rise in the source potential Vs_121 results from the driving current Ids_121 flowing through the driving transistor 121, increasing the driving current Ids_121 during threshold value correcting operation is considered as a measure method to make the source potential Vs_121 rise rapidly during threshold value correcting operation. Because the gate-to-source voltage Vgs_121 is determined by the gate potential Vg and the source potential Vs at each point in time during threshold value correcting operation and the threshold value correcting operation interval in the 1H-unit divided threshold value correcting process, it is considered to be necessary to adopt a method other than providing measures to the gate potential Vg_121 and the source potential Vs_121 themselves in order to solve the above-described problem by making the driving current Ids_121 of the driving transistor 121 different from the previous case. In other words, a mechanism of providing a difference to the driving current Ids_121 even when the gate-to-source voltage Vgs_121 is the same so that the source potential Vs_121 has a difference is considered to be an optimum measure method.

Accordingly, as a measure method according to the present embodiment, the speed of threshold value correcting operation is increased in effect by making the source potential Vs_121 on the organic EL element 127 side of the driving transistor 121 rise rapidly during threshold value correcting operation or at the time of a start of threshold value correcting operation in at least one threshold value correcting process period in the 1H-unit divided threshold value correcting process, and the effect of a rise in the source potential Vs_121 in the threshold value correcting operation interval in which the signal line potential after threshold value correcting operation is the signal potential Vin is reduced.

As a first measure method for making the source potential Vs_121 on the organic EL element 127 side of the driving transistor 121 rise rapidly during threshold value correcting operation, the threshold value correcting operation is repeated a plurality of divided times in at least one threshold value correcting process period in which the signal line potential (potential of the video signal line 106HS) is the offset potential Vofs (reference potential for threshold value correction) between the signal potential Vin reflecting light emission luminance to the next signal potential Vin.

That is, in the 1H-unit divided threshold value correcting process in which the threshold value correcting process is repeatedly performed a plurality of times with one horizontal scanning period as one process cycle, during at least one threshold value correcting process period, the threshold value correcting process is divided and repeatedly performed a plurality of times also in the period of the offset potential Vofs within one horizontal scanning period. The threshold value correcting process in which the threshold value correcting process is performed a plurality of times also in the period of the offset potential Vofs within one horizontal scanning period (1H) during at least one threshold value correcting process period on the basis of the 1H-unit divided threshold value correcting process will hereinafter be referred to as a "1H-unit divided threshold value correcting process to which an intra-1H threshold value correcting divided process is applied" or a "divided threshold value correcting process to which an intra-1H threshold value correcting divided process is applied."

As a second measure method for making the source potential Vs_121 on the organic EL element 127 side of the driving transistor 121 rise rapidly immediately before threshold value correcting operation, at a time of a start of (immediately before) threshold value correcting operation during a first threshold value correcting process period, the sampling transistor 125 is turned off when the drain current Vd_121 is changed to the first potential Vcc, and thereafter the sampling transistor 125 is turned on after the passage of a certain period to start the threshold value correcting operation. The second measure method is a mechanism of performing a first threshold value correcting operation after the source potential Vs_121 is raised rapidly in advance. Incidentally, while the second method is a mechanism for solving the problem caused by a rise in the source potential Vs_121 during the threshold value correcting operation interval in the 1H-unit divided threshold value correcting process, it is basically not essential to use the second method and the 1H-unit divided threshold value correcting process jointly.

Either of the measure methods turns off the sampling transistor 125 in a short period in which the phenomenon of failure of threshold value correction is prevented from occurring, thereby raises the gate potential Vg_121 and the source potential Vs_121 in a state in which the gate-to-source voltage Vgs_121 at that point in time is maintained, and thereafter turns on the sampling transistor 125 to set the gate potential Vg_121 to the offset potential Vofs and begin threshold value correcting operation. This provides an effect of increasing the speed of threshold value correcting operation in a threshold value correcting process period by a rise in the source potential Vs_121 in a range in which the phenomenon of failure of threshold value correction does not occur. It is thus possible to prevent threshold value correcting operation from not being performed normally due to a current flowing from the power supply through the driving transistor 121 in the subsequent threshold value correcting operation interval, and to obtain uniform image quality without stripes or unevenness. Further, because the speed of threshold value correcting operation during the threshold value correcting process period can be increased, it is possible to set the threshold value correcting process period shorter and thus achieve higher speed.

Incidentally, when the second measure method is adopted during the 1H-unit divided threshold value correcting process, the second measure method may be combined with the first measure method (the 1H-unit divided threshold value correcting process to which the intra-1H threshold value correcting divided process is applied) that performs the threshold value correcting process a plurality of times also in the period of the offset potential Vofs within one horizontal scanning period during a second threshold value correcting process period and thereafter. Concrete description will be made below of each measure method.

Improving Method

First Embodiment

Figure 9:
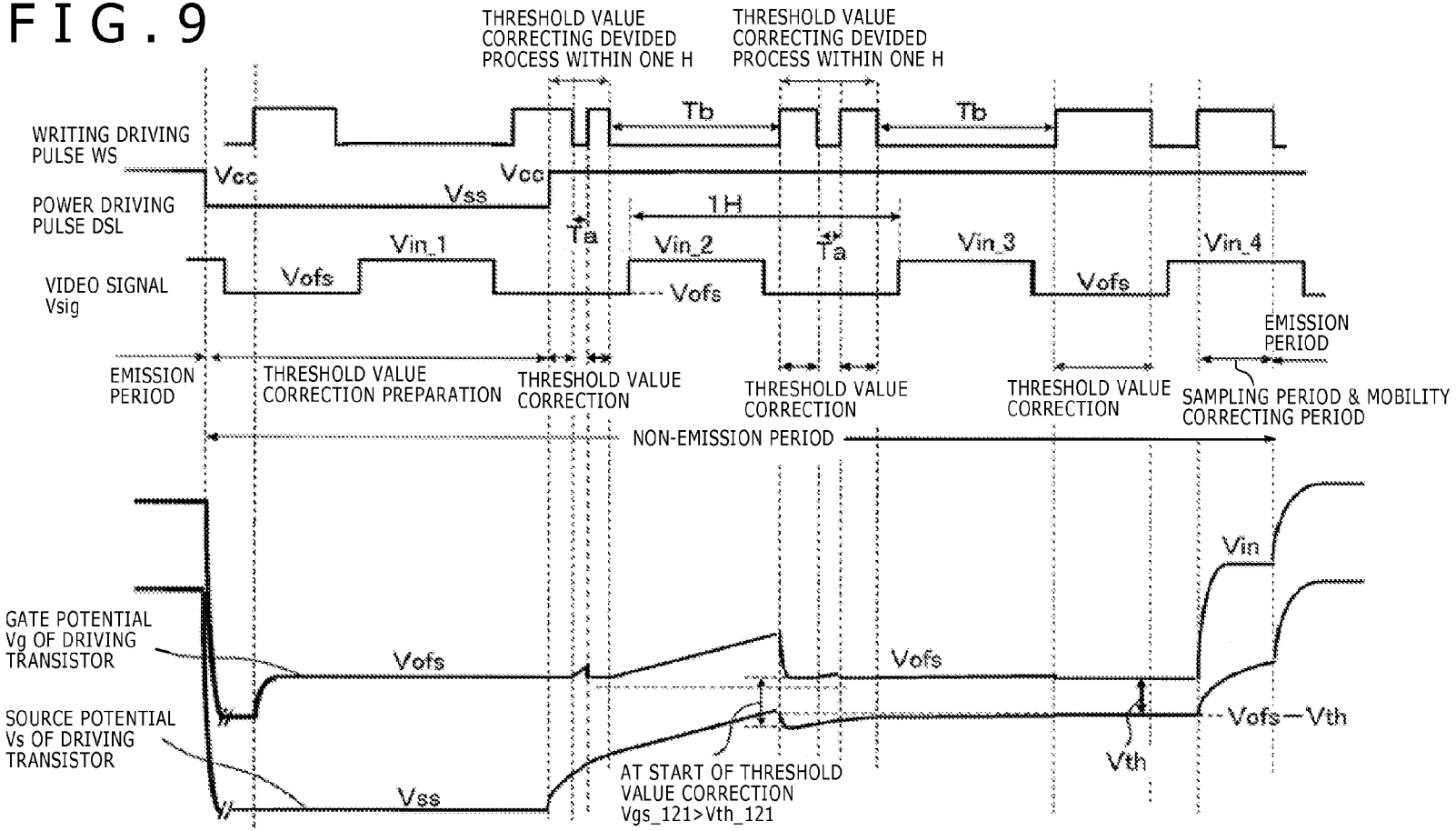
FIG. 9 is a diagram of assistance in explaining a first embodiment of a method for eliminating a phenomenon of failure of threshold value correction due to a rise in the source potential of the driving transistor in a threshold value correcting operation interval.

FIG. 9 is a diagram of assistance in explaining a first embodiment of a method for eliminating the phenomenon of failure of threshold value correction due to a rise in the source potential Vs_121 in the threshold value correcting operation interval. FIG. 9 is a timing chart in which the pixel circuit P according to the third comparative example shown in FIG. 6 is used as it is, and which represents the case of line-sequential driving. FIG. 9 shows changes in potential of the writing scanning line 104WS, changes in potential of the power supply line 105DSL, and changes in potential of the video signal line 106HS on a common time axis. In parallel with these potential changes, FIG. 9 also shows changes in the gate potential Vg and the source potential Vs of the driving transistor 121 for one row.

The first embodiment adopts the first measure method that repeatedly performs the threshold value correcting process a plurality of divided times also in the period of the offset potential Vofs within one horizontal scanning period during at least one threshold value correcting process period in the 1H-unit divided threshold value correcting process in which the threshold value correcting process is repeatedly performed a plurality of times with one horizontal scanning period as one process cycle. The first embodiment repeats the turning on of the sampling transistor 125 twice or more by repeating the turning on (conduction)/off (non-conduction) of the sampling transistor 125 during at least one threshold value correcting process period of threshold value correcting operation performed when the signal line potential is the offset potential Vofs in the 1H-unit divided threshold value correcting process.

It suffices to apply the intra-1H threshold value correcting divided process to at least one of a plurality of threshold value correcting process periods. The intra-1H threshold value correcting divided process may be applied to all the threshold value correcting process periods, or when the intra-1H threshold value correcting divided process is applied to only one threshold value correcting process period, it is basically free to choose to what number threshold voltage correction preparatory period of the plurality of threshold value correcting process periods to apply the intra-1H threshold value correcting divided process. In terms of effect, however, it is desirable to apply the intra-1H threshold value correcting divided process to at least one threshold value correcting process period, further divide the period of the offset potential Vofs into a plurality of periods, and perform the threshold value correcting process.

Thus, when divided threshold value correcting operation is performed by turning on/off the sampling transistor 125 a plurality of times also within one horizontal period in the 1H-unit divided threshold value correcting process, the sampling transistor 125 is off during an interval period between threshold value correcting operations and thus the gate potential Vg_121 and the source potential Vs_121 rise while the gate-to-source voltage Vgs of the driving transistor 121 remains constant also in the period of the offset potential Vofs within one horizontal period.

In a threshold value correcting operation interval Ta in a threshold value correcting operation period to which the intra-1H threshold value correcting divided process is applied, the source potential Vs_121 rises while the current corresponding to the gate-to-source voltage Vgs_121 resulting from the immediately preceding threshold value correcting operation remains. On the other hand, when the intra-1H threshold value correcting divided process is not applied, in a total threshold value correcting operation period including the same period as the threshold value correcting operation interval in the threshold value correcting operation period to which the intra-1H threshold value correcting divided process is applied, the source potential Vs_121 rises with the gate potential Vg_121 fixed at the offset potential Vofs. Therefore, as the threshold value correcting process progresses, the gate-to-source voltage Vgs_121 is reduced, and the current flowing through the driving transistor 121 is gradually decreased. Thus, a rise in the source potential Vs_121 also becomes gentle as the threshold value correcting process progresses.

Thus, by raising the source potential Vs_121 (and the gate potential Vg_121) with the sampling transistor 125 in an off state, the gate-to-source voltage Vgs_121 (potential across the storage capacitor 120) at the time of a start of a next threshold value correction is closer to the threshold voltage Vth than in the case where the intra-1H threshold value correcting divided process according to the present embodiment is not applied. Consequently, the speed of the threshold value correcting operation is increased. In other words, in the threshold value correcting operation interval when the intra-1H threshold value correcting divided process according to the present embodiment is applied, the gate-to-source voltage Vgs_121 is smaller from a viewpoint of threshold value correction in a 1H unit than when threshold voltage correction is made in the same period in the case where the intra-1H threshold value correcting divided process is not applied. Therefore the speed of the threshold value correcting operation itself in the 1H unit when the intra-1H threshold value correcting divided process is applied is faster than when the intra-1H threshold value correcting divided process is not applied.

In addition, the sampling transistor 125 is changed to an on state, an off state, and an on state in this order within a period that the signal line potential is the offset potential Vofs. However, a problem such as occurrence of the phenomenon of failure of threshold value correction due to the rising of the source potential Vs in the threshold value correcting operation interval does not occur because the off time Ta of an interval period (threshold value correcting operation interval during which the signal line potential is the offset potential Vofs and which does not straddle the period during which the signal line potential is the signal potential Vin) between threshold value correcting operations within one horizontal period is shorter than the off time Tb of an interval period (threshold value correcting operation interval straddling the period during which the signal line potential is the signal potential Vin) between threshold value correcting operations in each horizontal period in the 1H-unit divided threshold value correcting process.

Thus, according to the mechanism of the first embodiment, the speed of the threshold value correcting operation when the signal line potential is the offset potential Vofs between a signal potential Vin_1 and a next signal potential Vin_2 can be made faster than in driving timing according to the third comparative example (that is, the 1H-unit divided threshold value correcting process to which the present embodiment is not applied). Because the speed of the threshold value correcting operation becomes faster, the gate-to-source voltage Vgs_121 immediately after the threshold value correcting process period is smaller than in the case where the present measure method is not applied (which case will be referred to as the previous case) (that is, the gate-to-source voltage Vgs_121 immediately after the threshold value correcting process period is closer to the threshold voltage Vth). In the threshold value correcting operation interval after the threshold value correcting process period, a current flows through the driving transistor 121 in a state of the gate-to-source voltage Vgs_121 being smaller than in the previous case, and the source potential Vs_121 and the gate potential Vg_121 rise in a state of the gate-to-source voltage Vgs_121 at that point in time being maintained. Therefore, a rise in the source potential Vs_121 of the driving transistor 121 in the threshold value correcting operation interval is smaller than in the previous case.

As a result, the phenomenon of failure of threshold value correction which phenomenon is caused by the rising of the source potential Vs_121 due to a current flowing from the power supply through the driving transistor 121 in the threshold value correcting operation interval between threshold value correcting process periods, that is, the threshold value correcting operation interval straddling the period during which the signal line potential is the signal potential Vin (interval period between threshold value correcting process periods) is eased or prevented. It is possible to perform threshold value correcting operation normally, and thus obtain uniform image quality without unevenness or stripes. In addition, because the speed of threshold value correcting operation can be increased in a threshold value correcting process period to which the intra-1H threshold value correcting divided process is applied, the threshold value correcting process period can be set shorter, and thus the speed of the process can be increased.

Incidentally, in FIG. 9, in the 1H-unit divided threshold value correcting process in which the threshold value correcting process is repeatedly performed three times with one horizontal scanning period as one process cycle, the intra-1H threshold value correcting divided process is applied to the first two threshold value correcting process periods, but the intra-1H threshold value correcting divided process is not applied to the last threshold value correcting process period. However, the intra-1H threshold value correcting divided process may be applied to the last threshold value correcting process period.

Improving Method

Second Embodiment

Figure 10:
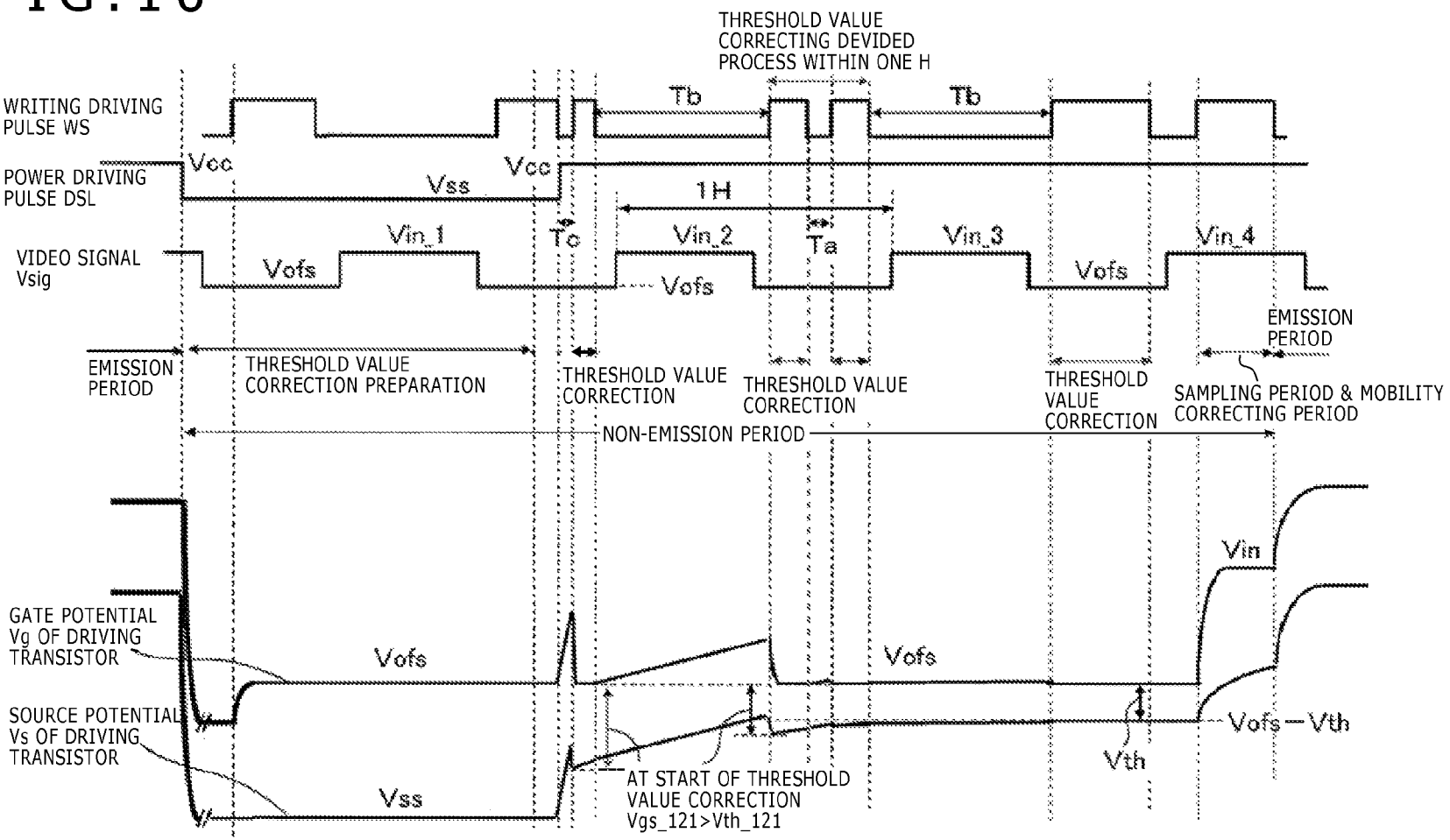
FIG. 10 is a diagram of assistance in explaining a second embodiment of the method for eliminating the phenomenon of failure of threshold value correction due to a rise in the source potential of the driving transistor in a threshold value correcting operation interval.

FIG. 10 is a diagram of assistance in explaining a second embodiment of the method for eliminating the phenomenon of failure of threshold value correction due to a rise in the source potential Vs_121 in the threshold value correcting operation interval. FIG. 10 is also a timing chart in which the pixel circuit P according to the third comparative example shown in FIG. 6 is used as it is, and which represents the case of line-sequential driving. FIG. 10 shows changes in potential of the writing scanning line 104WS, changes in potential of the power supply line 105DSL, and changes in potential of the video signal line 106HS on a common time axis. In parallel with these potential changes, FIG. 10 also shows changes in the gate potential Vg and the source potential Vs of the driving transistor 121 for one row.

The second embodiment adopts the second measure method in which at a time of a start of threshold value correcting operation during a first threshold value correcting process period, the sampling transistor 125 is turned off when the drain current Vd_121 is changed to the first potential Vcc, and thereafter the sampling transistor 125 is turned on after the passage of a certain period to start the threshold value correcting operation in the 1H-unit divided threshold value correcting process in which the threshold value correcting process is repeatedly performed a plurality of times with one horizontal scanning period as one process cycle.

That is, the power driving pulse DSL is raised from the second potential Vss to the first potential Vcc, a current is passed through the driving transistor 121, and the gate potential Vg_121 and the source potential Vs_121 are raised while the gate-to-source voltage Vgs_121 is maintained when the signal line potential is the offset potential Vofs and the sampling transistor 125 is off after a preparatory process for threshold value correcting processes and before a start of the first threshold value correcting process. After the passage of a certain time (Tc), the writing driving pulse WS is set active-H, the sampling transistor 125 is turned on, and the gate potential Vg_121 is set to the offset potential Vofs to begin threshold value correcting operation. In short, the second embodiment is characterized in that the source potential Vs_121 at the time of the start of the first threshold value correcting process is made closer to the gate potential Vg_121 (=Offset Potential Vofs) by raising the source potential Vs_121, that is, performing a preliminary raising process for the source potential Vs_121 while the sampling transistor 125 remains turned off before the start of the first threshold value correcting process.

Thus, when the power driving pulse DSL is changed from the second potential Vss to the first potential Vcc with the sampling transistor 125 set in an off state after initialization of the gate potential Vg_121 and the source potential Vs_121 prior to threshold value correcting operations and before the first threshold value correcting operation, and thereafter the sampling transistor 125 is turned on to supply the offset potential Vofs to the gate of the driving transistor 121 and start the threshold value correcting operation, the source potential Vs_121 can be rapidly raised in advance in a short period Tc in which the phenomenon of failure of threshold value correction is prevented from occurring before the start of the threshold value correcting operation.

The sampling transistor 125 is turned on, off, and on in this order, and the power driving pulse DSL is changed from the second potential Vss to the first potential Vcc before threshold value correcting operation during the first threshold value correcting process period during which the signal line potential is the offset potential Vofs. However, a problem such as occurrence of the phenomenon of failure of threshold value correction due to a rise in the source potential Vs_121 does not occur because the time Tc during which the gate potential Vg_121 and the source potential Vs_121 rise from the changing of the power driving pulse DSL to the first potential Vcc to the turning on of the sampling transistor 125 is shorter than the time Tb during which the gate potential Vg_121 and the source potential Vs_121 rise in an interval period (threshold value correcting operation interval straddling the period during which the signal line potential is the signal potential Vin) between threshold value correcting operations in each horizontal period in the 1H-unit divided threshold value correcting process.

In other words, it is important not only that "the time Tc be shorter than the time Tb" but also that the time Tc be set in a range in which the source potential Vs_121 on the organic EL element 127 side of the driving transistor 121 does not rise to "Vofs−Vth" so that the gate-to-source voltage Vgs_121 of the driving transistor 121 (voltage across the storage capacitor 120) at the time of the start of the first threshold value correcting process is prevented from becoming less than the threshold voltage Vth when the source potential Vs_121 at the time of the start of the first threshold value correcting process is made closer to the gate potential Vg_121 (=Offset Potential Vofs).

As a result, the speed of the threshold value correcting operation in the first threshold value correcting process period can be increased, and the amount of a rise in the source potential Vs_121 of the driving transistor 121 in the interval period between the first and second threshold value correcting process periods can be made smaller than in the case where the present embodiment is not applied. Hence, as in the first embodiment, it is possible to prevent threshold value correcting operation from not being performed normally due to a current flowing from the power supply through the driving transistor 121 in a threshold value correcting operation interval straddling a period during which the signal line potential is the signal potential Vin. Threshold value correcting operation can be performed normally, and thus uniform image quality without unevenness or stripes can be obtained. In addition, because the speed of threshold value correcting operation can be increased in the first threshold value correcting process period by rapidly raising the source potential Vs_121 in advance, as in the first embodiment, the threshold value correcting process period can be set shorter, and thus the speed of the process can be increased.

Incidentally, in FIG. 10, the 1H-unit divided threshold value correcting process in which the threshold value correcting process is repeatedly performed three times with one horizontal scanning period as one process cycle is combined with the method according to the first embodiment to which the intra-1H threshold value correcting divided process is applied in the second threshold value correcting process period. However, the combination with the first embodiment is not essential. Of course, as in the first embodiment, the intra-1H threshold value correcting divided process may be applied also to the last threshold value correcting process period.

While the present invention has been described above using embodiments thereof, the technical scope of the present invention is not limited to a scope described in the foregoing embodiments. Various changes and improvements can be made to the foregoing embodiments without departing from the spirit of the invention, and forms obtained by adding such changes and improvements are also included in the technical scope of the present invention.

In addition, the foregoing embodiments do not limit inventions of claims, and not all combinations of features described in the embodiments are necessarily essential to solving means of the invention. The foregoing embodiments include inventions in various stages, and various inventions can be extracted by appropriately combining a plurality of disclosed constitutional requirements. Even when a few constitutional requirements are omitted from all the constitutional requirements disclosed in the embodiments, constitutions resulting from the omission of the few constitutional requirements can be extracted as inventions as long as an effect is obtained.

<Examples of Modification of Pixel Circuit>

For example, changes can be made from a mode of the pixel circuit P. For example a "duality principle" holds in circuit theory, and thus modifications can be made to the pixel circuit P from this viewpoint. In this case, though not shown in figures, while the pixel circuit P shown in each of the foregoing embodiments is formed using an n-channel type driving transistor 121, the pixel circuit P is formed using a p-channel type driving transistor 121. Changes following the duality principle are made accordingly, such for example as reversing the polarity of the signal amplitude ΔVin with respect to the offset potential Vofs of the video signal Vsig and relation of magnitude of the power supply voltage.

For example, in a pixel circuit P in a mode of modification following the "duality principle," a storage capacitor 120 is connected between the gate terminal and the source terminal of a p-type driving transistor (hereinafter referred to as a p-type driving transistor 121*p*), and the source terminal of the p-type driving transistor 121*p* is directly connected to the cathode terminal of an organic EL element 127. The anode terminal of the organic EL element 127 is set at an anode potential Vanode as a reference potential. The anode potential Vanode is connected to a reference power supply (high potential side) that supplies the reference potential and which is common to all pixels. The p-type driving transistor 121*p* has a drain terminal thereof connected to a first potential Vss on a low voltage side. The p-type driving transistor 121*p* feeds a driving current Ids for making the organic EL element 127 emit light.

An organic EL display device according to the example of modification in which the driving transistor 121 is changed to a p-type by applying such a duality principle can perform threshold value correcting operation, mobility correcting operation, and bootstrap operation as with the organic EL display device using the n-type driving transistor 121.

When such a pixel circuit P is driven, a similar mode to that of the first embodiment can be adopted in which the threshold value correcting process is divided and repeatedly performed a plurality of times also in the period of the offset potential Vofs within one horizontal scanning period during at least one threshold value correcting process period. In addition, a similar mode to that of the second embodiment can be adopted in which at a time of a start of threshold value correcting operation in a first threshold value correcting process period, the sampling transistor 125 is turned off when the drain current Vd_121 is changed to the first potential Vcc, and thereafter the sampling transistor 125 is turned on after the passage of a certain period to start the threshold value correcting operation. Of course, a mode in which these modes are combined with each other can be adopted. It is possible to reduce the driving current Ids_121*p* flowing through the p-type driving transistor 121*p* in a threshold value correcting operation interval, and therefore perform threshold value correcting operation normally. Thus, because threshold value correcting operation can be performed normally, uniform image quality without unevenness or stripes can be obtained.

It is to be noted that while the example of modification of the pixel circuit P as described above is obtained by making changes following the "duality principle" to the configurations shown in the foregoing first to second embodiments, a method of changing the circuit is not limited to this. The number of transistors forming the pixel circuit P is arbitrary as long as in performing threshold value correcting operation, driving is performed such that the video signal Vsig changing between the offset potential Vofs and the signal potential Vin (=Vofs+ΔVin) within each horizontal period according to scanning by the writing scanning section 104 is transmitted to the video signal line 106HS, and the drain side (power supply side) of the driving transistor 121 is switching-driven between the first potential and the second potential for the initializing operation of threshold value correction. It does not matter whether the pixel circuit P is of the 2TR configuration or not, and the number of transistors may be three or more. The concept of the present embodiments of remedying the phenomenon of failure of threshold value correction due to the rising of the source potential Vs_121 in a threshold value correcting operation interval by applying the improving methods of the present embodiments described above can be applied to all of those configurations.

In addition, the mechanism of supplying the offset potential Vofs and the signal potential Vin to the gate of the driving transistor 121 in performing threshold value correcting operation is not limited to making provision by the video signal Vsig as in the 2TR configuration of the foregoing embodiments. For example, a mechanism of supplying the offset potential Vofs and the signal potential Vin via another transistor as described in Patent Document 1, for example, can be adopted as the mechanism of supplying the offset potential Vofs and the signal potential Vin to the gate of the driving transistor 121. Also in these examples of modification, the concept of the present embodiments of remedying the phenomenon of failure of threshold value correction due to the rising of the source potential Vs_121 in a threshold value correcting operation interval by applying the improving methods of the present embodiments described above can be applied.

In addition, the concept of the foregoing embodiments can be theoretically applied to the mechanism described in Patent Document 1. However, because the threshold value correcting process described in Patent Document 1 can take a sufficient time for one time of threshold value correction, it can be said that there is not much need for the foregoing embodiments as compared with the 2TR configuration and various examples of modification based on the 2TR configuration.

The present application contains subject matter related to that disclosed in Japanese Priority Patent Application JP 2008-165201 filed in the Japan Patent Office on Jun. 25, 2008, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A display device comprising:

a pixel array section having pixel circuits arranged in a form of a matrix, a given one of said pixel circuits including: a driving transistor for generating a driving current, an electrooptic element connected to an output terminal of said driving transistor, a storage capacitor for retaining information corresponding to a signal amplitude of a video signal, and a sampling transistor for writing the information corresponding to said signal amplitude to said storage capacitor;

a vertical scanning section configured to generate vertical scanning pulses for vertical scanning of said pixel circuits; and a horizontal scanning section configured to supply the video signal to said pixel circuits so as to coincide with said vertical scanning in said vertical scanning section;

wherein said given one of said pixel circuits is configured for a driving signal constancy function for holding said driving current constant;

wherein said given one of said pixel circuits is configured for a threshold value correcting function that makes said storage capacitor retain a voltage corresponding to a threshold voltage of said driving transistor;

wherein said vertical scanning section and said horizontal scanning section are configured to cause said given one of said pixel circuits to realize said threshold value correcting function through a threshold value correcting process comprising making said sampling transistor conduct while current is flowing through said driving transistor and a reference potential is supplied to an input terminal of said sampling transistor, and wherein said vertical scanning section and said horizontal scanning section are configured to cause said given one of said pixel circuits to:

perform said threshold value correcting process during a plurality of horizontal scanning periods within a given non-emission period while the state of the current flowing through said driving transistor is maintained, and perform a threshold value correcting divided process within at least one of said plurality of horizontal periods, said threshold value correcting divided process comprising, within a single horizontal period:

performing said threshold value correcting process;

thereafter, placing said sampling transistor in a non-conducting state while said reference potential is supplied to the input terminal of said sampling transistor; and thereafter, performing said threshold value correcting process again.

2. The display device according to claim 1, wherein, during performance of said threshold value correcting divided process, the duration of an interval period during which said sampling transistor is in a non-conducting state while said reference potential is supplied to the input terminal of said sampling transistor is shorter than the duration of an interval period between threshold value correcting processes that are performed in different horizontal scanning periods.

3. The display device according to claim 1, wherein said threshold value correcting divided process is performed in the first of said plurality of horizontal periods in which said threshold value correcting process is performed within the given non-emission period.

4. The display device according to claim 1, wherein said vertical scanning section has:

a writing scanning section configured to supply a control input terminal of said sampling transistor with a writing scanning pulse for vertically scanning said pixel circuits and writing the information corresponding to said signal amplitude to said storage capacitor, and a driving scanning section configured to change between a first potential used to feed said driving current to said electrooptic element and a second potential different from said first potential and to supply said first and second potentials to a power supply terminal of said driving transistor, wherein said horizontal scanning section supplies said video signal, which selectively changes between said reference potential and a signal potential, to the input terminal of said sampling transistor, and wherein said writing scanning section, said horizontal driving section, and said driving scanning section are configured to cause said pixel circuit to realize the threshold value correcting function by supplying a voltage corresponding to said first potential to said power supply terminal of said driving transistor and making said sampling transistor conduct while said reference potential of the video signal is supplied to the input terminal of said sampling transistor.

5. The display device according to claim 1, wherein said threshold value correcting divided process is performed in more than one of said plurality of horizontal periods within the given non-emission period.

6. A display device comprising:

a pixel array section having pixel circuits arranged in a form of a matrix, a given one of said pixel circuits including: a driving transistor for generating a driving current, an electrooptic element connected to an output terminal of said driving transistor, a storage capacitor for retaining information corresponding to a signal amplitude of a video signal, and a sampling transistor for writing the information corresponding to said signal amplitude to said storage capacitor;

a vertical scanning section configured to generate vertical scanning pulses for vertical scanning of said pixel circuits; and a horizontal scanning section configured to supply the video signal to said pixel circuits so as to coincide with said vertical scanning in said vertical scanning section;

wherein said given one of said pixel circuits is configured for a driving signal constancy function for holding said driving current constant;

wherein said given one of said pixel circuits is configured for a threshold value correcting function that makes said storage capacitor retain a voltage corresponding to a threshold voltage of said driving transistor;

wherein said vertical scanning section and said horizontal scanning section are configured to:

cause said given one of said pixel circuits to realize said threshold value correcting function through a threshold value correcting process comprising making said sampling transistor conduct while current is flowing through said driving transistor and a reference potential is being supplied to an input terminal of said sampling transistor, and cause said given one of said pixel circuits to perform a preparatory process that sets a voltage across said storage capacitor so as to exceed the threshold voltage of said driving transistor prior to performing a first threshold value correcting process within a given non-emission period, simultaneously set said sampling transistor in a non-conducting state and pass a current through said driving transistor after said preparatory process and before a start of said first threshold value correcting process within said given non-emission period, and then, after a predetermined period of time, start said first threshold value correcting process by switching said sampling transistor to a conducting state.

7. The display device according to claim 6, wherein said threshold value correcting process is performed during a plurality of horizontal scanning periods within said given non-emission period while the current remains flowing through said driving transistor.

8. The display device according to claim 7, wherein the duration of a period during which said sampling transistor is set in a non-conducting state and the current is passed through said driving transistor after said preparatory process and before the start of said first threshold value correcting process within said given non-emission period is shorter than the duration of an interval period between threshold value correcting processes that are performed in different horizontal scanning periods.

9. The display device according to claim 7, wherein said vertical scanning section and said horizontal scanning section are further configured to cause said given one of said pixel circuits to perform a threshold value correcting divided process within at least one of said plurality of horizontal periods, said threshold value correcting divided process comprising, within a single horizontal period:

performing said threshold value correcting process;

thereafter, placing said sampling transistor in a non-conducting state while said reference potential is supplied to the input terminal of said sampling transistor; and thereafter, performing said threshold value correcting process again.

10. The display device according to claim 9, wherein said threshold value correcting divided process is performed in the second one of said plurality of horizontal periods in which said threshold value correcting process is performed within the given non-emission period.

11. The display device according to claim 6, wherein the duration of a period during which said sampling transistor is set in a non-conducting state and the current is passed through said driving transistor after said preparatory process and before the start of said first threshold value correcting process within said given non-emission period is set to a predetermined value such that the voltage across said storage capacitor is not less than the threshold voltage of said driving transistor at a time of the start of said first threshold value correcting process within said given non-emission period.

12. The display device according to claim 6, wherein said vertical scanning section includes:

a writing scanning section configured to supply a control input terminal of said sampling transistor with a writing scanning pulse for vertically scanning said pixel circuits and writing the information corresponding to said signal amplitude to said storage capacitor, and a driving scanning section configured to change between a first potential used to feed said driving current to said electrooptic element and a second potential different from said first potential and to supply said first and second potentials to a power supply terminal of said driving transistor, said horizontal scanning section supplies said video signal, which selectively changes between said reference potential and a signal potential, to the input terminal of said sampling transistor, and said writing scanning section, said horizontal driving section, and said driving scanning section are configured to cause said given one of said pixel circuits to realize the threshold value correcting function by supplying a voltage corresponding to said first potential to said power supply terminal of said driving transistor and making said sampling transistor conduct while said reference potential of the video signal is supplied to the input terminal of said sampling transistor.

13. The display device according to claim 6, wherein said vertical scanning section includes a driving scanning section configured to change between a first potential used to feed said driving current to said electrooptic element and a second potential different from said first potential and to supply said first and second potentials to a power supply terminal of said driving transistor, and said preparatory process that sets a voltage across said storage capacitor so as to exceed the threshold voltage of said driving transistor comprises making said sampling transistor conduct while (i) a reference potential is being supplied to an input terminal of said sampling transistor and (ii) said second potential is being supplied to said power supply terminal of said driving transistor.

14. A method of driving a display device that comprises a pixel circuit including a driving transistor for generating a driving current, an electrooptic element connected to an output terminal of said driving transistor, a storage capacitor for retaining information corresponding to a signal amplitude of a video signal, and a sampling transistor for writing the information corresponding to said signal amplitude to said storage capacitor, the method comprising:

causing said storage capacitor to retain a voltage corresponding to a threshold voltage of said driving transistor by performing a threshold value correcting process during a plurality of horizontal scanning periods within a given non-emission period, said threshold value correcting process comprising making said sampling transistor conduct while current is flowing through said driving transistor and a reference potential is supplied to an input terminal of said sampling transistor, and performing a threshold value correcting divided process within at least one of said plurality of horizontal periods, said threshold value correcting divided process comprising, within a single horizontal period:

performing said threshold value correcting process;

thereafter, placing said sampling transistor in a non-conducting state while said reference potential is supplied to the input terminal of said sampling transistor; and thereafter, performing said threshold value correcting process again.

15. The method according to claim 14, wherein, during performance of said threshold value correcting divided process, the duration of an interval period during which said sampling transistor is in a non-conducting state while said reference potential is supplied to the input terminal of said sampling transistor is shorter than the duration of an interval period between threshold value correcting processes that are performed in different horizontal scanning periods.

16. The method according to claim 14, wherein said threshold value correcting divided process is performed in the first of said plurality of horizontal periods in which said threshold value correcting process is performed within the given non-emission period.

17. The method according to claim 14, further comprising performing said threshold value correcting divided process in more than one of said plurality of horizontal periods within the given non-emission period.

18. A method of driving a display device that comprises a pixel circuit including a driving transistor for generating a driving current, an electrooptic element connected to an output terminal of said driving transistor, a storage capacitor for retaining information corresponding to a signal amplitude of a video signal, and a sampling transistor for writing the information corresponding to said signal amplitude to said storage capacitor, the method comprising:

causing said storage capacitor to retain a voltage corresponding to a threshold voltage of said driving transistor by performing a threshold value correcting process during a plurality of horizontal scanning periods within a given non-emission period, said threshold value correcting process comprising making said sampling transistor conduct while current is flowing through said driving transistor and a reference potential is supplied to an input terminal of said sampling transistor causing said pixel circuit to perform a preparatory process that sets a voltage across said storage capacitor so as to exceed a threshold voltage of said driving transistor before a start of a first threshold value correcting process of said given non-emission period, simultaneously setting said sampling transistor in a non-conducting state and passing a current through said driving transistor after said preparatory process and before a start of a first threshold value correcting process, and then, after a predetermined period of time, starting said first threshold value correcting process within said given non-emission period by switching said sampling transistor to a conducting state.

19. The method according to claim 18, wherein the duration of a period during which said sampling transistor is set in a non-conducting state and the current is passed through said driving transistor after said preparatory process and before the start of said first threshold value correcting process within said given non-emission period is shorter than the duration of an interval period between threshold value correcting processes that are performed in different horizontal scanning periods.

20. The method according to claim 18, further comprising:

performing a threshold value correcting divided process within at least one of said plurality of horizontal periods, said threshold value correcting divided process comprising, within a single horizontal period:

performing said threshold value correcting process;

thereafter, placing said sampling transistor in a non-conducting state while said reference potential is supplied to the input terminal of said sampling transistor; and thereafter, performing said threshold value correcting process again.

* * * * *